US007645010B2

(12) United States Patent
Otsuka

(10) Patent No.: US 7,645,010 B2
(45) Date of Patent: Jan. 12, 2010

(54) INK EJECTION AMOUNT MEASUREMENT METHOD AND INK EJECTION AMOUNT MEASUREMENT SYSTEM

(75) Inventor: Hiroyuki Otsuka, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 278 days.

(21) Appl. No.: 11/905,112

(22) Filed: Sep. 27, 2007

(65) Prior Publication Data

US 2008/0259108 A1 Oct. 23, 2008

(30) Foreign Application Priority Data

Sep. 28, 2006 (JP) ..... 2006-265491

(51) Int. Cl.
*B41J 2/205* (2006.01)

(52) U.S. Cl. ..... 347/15; 347/19

(58) Field of Classification Search ..... 347/12, 347/15, 43, 19, 40; 358/1.2, 1.9
See application file for complete search history.

(56) References Cited

U.S. PATENT DOCUMENTS

| | | | | |
|---|---|---|---|---|
| 5,099,259 | A * | 3/1992 | Hirahara et al. | 347/183 |
| 5,384,587 | A * | 1/1995 | Takagi et al. | 347/41 |
| 6,084,604 | A * | 7/2000 | Moriyama et al. | 347/15 |
| 6,270,178 | B1 | 8/2001 | Wada et al. | |
| 2003/0007024 | A1 * | 1/2003 | Fujimori | 347/15 |

FOREIGN PATENT DOCUMENTS

| | | | |
|---|---|---|---|
| JP | 9-48111 | A | 2/1997 |
| JP | 10-230593 | A | 9/1998 |

* cited by examiner

*Primary Examiner*—Lamson D Nguyen
(74) *Attorney, Agent, or Firm*—Birch, Stewart, Kolasch & Birch, LLP

(57) ABSTRACT

The ink ejection amount measurement method for an inkjet recording head, includes: an ink ejection step of ejecting ink onto a recording medium from a recording head by applying a drive voltage to the recording head, in such a manner that an ink dot image is formed on the recording medium; an image reading step of reading the ink dot image formed on the recording medium by means of an image reading device; a number of pixels measurement step of measuring number of pixels occupied by the ink dot image formed on the recording medium; a correlation table preparation step of preparing a correlation table representing a correlation among a value of the drive voltage, number of pixels occupied by an ink dot image formed on the recording medium, and an ink ejection amount ejected by the recording head; a drive voltage sweeping step of changing a value of the drive voltage applied to the recording head, from a first drive voltage measurement value which is a value of the drive voltage when the number of pixels measured in the number of pixels measurement step is a first number of pixels, to a second drive voltage measurement value which is a value of the drive voltage at a boundary where the number of pixels measured in the number of pixels measurement step changes from the first number of pixels to a second number of pixels; and an ink ejection amount calculation step of calculating the ink ejection amount when a drive voltage having the first drive voltage measurement value is applied to the recording head, according to the correlation table, using the first drive voltage measurement value and the second drive voltage measurement value.

6 Claims, 21 Drawing Sheets

| VOLTAGE (V) | DROPLET VOLUME (pl) | NUMBER OF PIXELS | DOT DIAMETER (μm) |
|---|---|---|---|
| 0 | 0 | 0 | 0 |
| ⋮ | ⋮ | 4 | ⋮ |
| | | 4 | |
| 1 | 0.05 | 12 | 8.77 |
| ⋮ | ⋮ | 12 | ⋮ |
| | | 12 | |
| 5 | 0.25 | 16 | 15.0 |
| ⋮ | ⋮ | 16 | ⋮ |
| | | 16 | |
| 10 | 0.5 | 24 | 18.9 |
| ⋮ | ⋮ | 24 | ⋮ |
| | | 24 | |
| 20 | 1 | 32 | 23.8 |
| ⋮ | ⋮ | 32 | ⋮ |
| | | 32 | |
| 40 | 2 | 36 | 30 |
| ⋮ | ⋮ | 36 | ⋮ |
| | | 36 | |
| | | 36 | |

FIG.8

| VOLTAGE (V) | DROPLET VOLUME (pl) | NUMBER OF PIXELS | DOT DIAMETER (μm) |
|---|---|---|---|
| 0 | 0 | 0 | 0 |
| ⋮ | ⋮ | 4 | ⋮ |
| | | 4 | |
| 1 | 0.05 | 12 | 8.77 |
| ⋮ | ⋮ | 12 | ⋮ |
| | | 12 | |
| 5 | 0.25 | 16 | 15.0 |
| ⋮ | ⋮ | 16 | ⋮ |
| | | 16 | |
| 10 | 0.5 | 24 | 18.9 |
| ⋮ | ⋮ | 24 | ⋮ |
| | | 24 | |
| 20 | 1 | 32 | 23.8 |
| ⋮ | ⋮ | 32 | ⋮ |
| | | 32 | |
| 40 | 2 | 36 | 30 |
| ⋮ | ⋮ | 36 | ⋮ |
| | | 36 | |
| | | 36 | |

FIG.14

| VOLTAGE (V) | DROPLET VOLUME (pl) | NUMBER OF PIXELS | DOT DIAMETER (μm) |
|---|---|---|---|
| 0 | 0 | 4 | 0 |
| ⋮ | ⋮ | 4 | ⋮ |
| | | 4 | |
| 1 | 0.05 | 4 | 8.77 |
| ⋮ | ⋮ | 4 | ⋮ |
| | | 4 | |
| 5 | 0.25 | 4 | 15.0 |
| ⋮ | ⋮ | 4 | ⋮ |
| | | 4 | |
| 10 | 0.5 | 4 | 18.9 |
| ⋮ | ⋮ | 4 | ⋮ |
| | | 4 | |
| 20 | 1 | 4 | 23.8 |
| ⋮ | ⋮ | 4 | ⋮ |
| | | 4 | |
| 40 | 2 | 12 | 30 |
| ⋮ | ⋮ | 12 | ⋮ |
| | | 12 | |
| | | 12 | |

FIG.17

| VOLTAGE (V) | DROPLET VOLUME (pl) | NUMBER OF PIXELS | DOT DIAMETER (μm) |
|---|---|---|---|
| 0 | 0 | 0 | 0 |
| ⋮ | ⋮ | 4 | ⋮ |
| | | 4 | |
| 1 | 0.05 | 4 | 8.77 |
| ⋮ | ⋮ | 4 | ⋮ |
| | | 4 | |
| 5 | 0.25 | 12 | 15.0 |
| ⋮ | ⋮ | 12 | ⋮ |
| | | 12 | |
| 10 | 0.5 | 12 | 18.9 |
| ⋮ | ⋮ | 12 | ⋮ |
| 14 | 0.7 | 16 | 21.2 |
| 20 | 1 | 16 | 23.8 |
| ⋮ | ⋮ | 16 | ⋮ |
| | | 16 | |
| 40 | 2 | 24 | 30 |
| ⋮ | ⋮ | 24 | ⋮ |
| | | 24 | |
| | | 24 | |

FIG.20

| VOLTAGE (V) | DROPLET VOLUME (pl) | NUMBER OF PIXELS | DOT DIAMETER (μm) |
|---|---|---|---|
| 0 | 0 | 0 | 0 |
| ⋮ | ⋮ | 4 | ⋮ |
| | | 4 | |
| 1 | 0.05 | 12 | 8.77 |
| ⋮ | ⋮ | 12 | ⋮ |
| | | 12 | |
| 5 | 0.25 | 16 | 15.0 |
| ⋮ | ⋮ | 16 | ⋮ |
| | | 16 | |
| 10 | 0.5 | 24 | 18.9 |
| ⋮ | ⋮ | 24 | ⋮ |
| | | 24 | |
| 20 | 1 | 32 | 23.8 |
| ⋮ | ⋮ | 32 | ⋮ |
| | | 32 | |
| 40 | 2 | 36 | 30 |
| ⋮ | ⋮ | 36 | ⋮ |
| | | 36 | |
| | | 36 | |

INK EJECTION AMOUNT MEASUREMENT METHOD AND INK EJECTION AMOUNT MEASUREMENT SYSTEM

BACKGROUND OF THE INVENTION

1. Field of the Invention

The present invention relates to an ink ejection amount measurement method and an ink ejection amount measurement system, and more particularly, to an ink ejection amount measurement method and ink ejection amount measurement system whereby the ink ejection amount can be measured accurately even using an image reading device of low resolution in an inexpensive system.

2. Description of the Related Art

In inkjet recording apparatuses, it is important from the viewpoint of stabilizing print quality that the ink ejection amount should be uniform from each of a plurality of nozzles formed in a recording head. Therefore, it is sought to achieve accurate measurement of the amount of ink ejected from each of the nozzles during maintenance, or the like.

Therefore, a conventional method for measuring very small droplet amounts, such as those of colored inks, uses either an ink droplet amount measurement method based on a weight measurement method, or a droplet amount measurement based on a light absorption method.

An ink droplet amount measurement method based on weight measurement involves first ejecting ink for a prescribed time period at prescribed time intervals, and then measuring the amount (weight) of ink used during that time period, by means of a chemical balance, or the like. Thereupon, the average liquid droplet amount (average ejection amount) per ejection is determined by dividing the amount of ink used by the number of ink ejections performed.

Furthermore, a droplet volume measurement method involves firstly sealing the ink inside a transparent container, and then radiating light of a certain intensity to one side and measuring the light passing via the opposite side (light absorption rate). Thereupon, since the light absorption rate is known to be directly proportional to the ink density (according to Lambert-Beer law), then the ink density is determined by means of this method. In order to measure the droplet volume, an observation amount graph which indicates the relationship between the ink density and the ink ejection amount is determined previously, the droplet volume is calculated from the ink density thus obtained, and the average ejection amount per ejection operation is determined by dividing the droplet volume by the number of ejection operations.

Japanese Patent Application Publication No. 9-48111 and Japanese Patent Application Publication No. 10-230593 disclose the technique in which, the correlation (calibration curve) between the density and droplet volume is previously determined according to a method based on light absorption, the apparatus is on line, a transmission light source and a CCD are used in such a manner that the (transmitted) luminance (the reciprocal of the density) is measured by the CCD, and the ejection amount per nozzle is measured instantly from the calibration curve.

Japanese Patent Application Publication No. 9-48111 and Japanese Patent Application Publication No. 10-230593 teach an embodiment using a CCD camera which outputs 256 tonal levels (8-bit) having pixel density from 0 to 255, but it makes no mention of the minimum pixel resolution of the CCD camera. Consequently, if the minimum pixel resolution of the CCD camera is a low resolution, then the pixel resolution also varies. Furthermore, if it is sought to measure the ink dot diameter with good accuracy by means of a CCD camera or scanner having low resolution, then it is necessary to prepare a separate test pattern.

SUMMARY OF THE INVENTION

The present invention has been contrived in view of these circumstances, an object thereof being to provide a method whereby the ink ejection amount can be measured with good accuracy by using a scanner or CCD camera of low resolution in an inexpensive system, without requiring a calibration curve or a test pattern.

In order to attain the aforementioned object, the present invention is directed to an ink ejection amount measurement method for an inkjet recording head, the ink ejection amount measurement method comprising: an ink ejection step of ejecting ink onto a recording medium from a recording head by applying a drive voltage to the recording head, in such a manner that an ink dot image is formed on the recording medium; an image reading step of reading the ink dot image formed on the recording medium by means of an image reading device; a number of pixels measurement step of measuring number of pixels occupied by the ink dot image formed on the recording medium; a correlation table preparation step of preparing a correlation table representing a correlation among a value of the drive voltage, number of pixels occupied by an ink dot image formed on the recording medium, and an ink ejection amount ejected by the recording head; a drive voltage sweeping step of changing a value of the drive voltage applied to the recording head, from a first drive voltage measurement value which is a value of the drive voltage when the number of pixels measured in the number of pixels measurement step is a first number of pixels, to a second drive voltage measurement value which is a value of the drive voltage at a boundary where the number of pixels measured in the number of pixels measurement step changes from the first number of pixels to a second number of pixels; and an ink ejection amount calculation step of calculating the ink ejection amount when a drive voltage having the first drive voltage measurement value is applied to the recording head, according to the correlation table, using the first drive voltage measurement value and the second drive voltage measurement value.

According to this aspect of the present invention, the drive voltage is changed in such a manner that the number of pixels changes from the first number of pixels to the second number of pixels, and the actual ink ejection amount when the drive voltage before change is applied is calculated by means of a previously created correlation table, using the drive voltage values before and after change. Therefore, it is possible to measure the ink ejection amount with good accuracy, even using an image reading device of essentially low resolution in an inexpensive system.

In the drive voltage sweeping step, the drive voltage is changed in increments of a prescribed amount, from the first drive voltage measurement value, ink is ejected onto the recording medium each time the drive voltage is changed, the ink dot image formed on the recording medium is read in by the image reading device, and the number of pixels occupied by the ink dot image is measured. Thereupon, this sequence of operations is repeated until the number of pixels changes from the first number of pixels to the second number of pixels.

Furthermore, in the calculation of the ink ejection amount calculation step, if the first drive voltage measurement value which is the value of the drive voltage when the actually measured number of pixels is a first number of pixels, is taken to be $V_0$, the theoretical boundary drive voltage which is the theoretical value of the drive voltage in the boundary region where the number of pixels theoretically changes from the first number of pixels to the second number of pixels, is taken to be $V_{pixel}$, and the drive voltage in the boundary region where the measured number of pixels actually changes from the first number of pixels to the second number of pixels, is taken to be $V_{measure}$, then the apparent drive voltage value can be determined from the formula $V=V_0-(V_{measure}-V_{pixel})$, and using this apparent drive voltage V and the ink ejection amount, the actual ink ejection amount when the first drive voltage measurement value $V_0$ is applied as the drive voltage value can be determined from the correlation table. Here, "theoretical" means a value that is ascertained prior to the liquid droplet subject to measurement, such as a value determined by experimentation or a value based on a simulation. Thereupon, the "theoretical value of the drive voltage" is a drive voltage value held in the correlation table prior to the liquid droplet subject to measurement.

Furthermore, it is also possible to substitute, in the correlation table, "ink droplet volume" for the "ink ejection amount", or to create both "ink ejection amount" and "ink droplet volume" in the correlation table.

In "ejecting ink onto a recording medium from a recording head by applying a drive voltage", for example, an actuator is caused to deform by applying a drive voltage between an individual electrode and a common electrode, thereby changing the volume of the pressure chamber, ink being ejected from the nozzle due to the resulting pressure change.

"Recording medium" indicates a medium on which an image is recorded by means of the action of the recording head (this medium may also be called an image forming medium, image receiving medium, or, in the case of an inkjet recording apparatus, an ejection medium or ejection receiving medium, or the like). This term includes various types of media, irrespective of material and size, such as continuous paper, cut paper, sealed paper, resin sheets, such as OHP sheets, film, cloth, an intermediate transfer body, a printed circuit board on which a wiring pattern, or the like, is printed by means of an inkjet recording apparatus, and the like.

For the "image reading device", it is possible to use an image reading apparatus based on an image sensor (imaging element) (including a signal processing device for processing the captured image signal). For example, a CCD scanner, or the like, may also be used.

Preferably, the ink ejection amount measurement method further comprises a recording medium type determination step of determining a type of the recording medium, wherein, in the correlation table preparation step, the correlation table is prepared in accordance with the type of the recording medium determined in the recording medium type determination step.

According to this aspect of the present invention, since a correlation table is created in accordance with the type of the recording medium, then it is possible to measure the ink ejection amount with good accuracy, in accordance with change in the environmental conditions.

Preferably, the ink ejection amount measurement method further comprises a recording head temperature determination step of determining temperature of the recording head, wherein, in the correlation table preparation step, the correlation table is prepared in accordance with the temperature of the recording head determined in the recording head temperature determination step.

According to this aspect of the present invention, since a correlation table is created in accordance with the temperature of the recording head, then it is possible to measure the ink ejection amount with good accuracy, in accordance with change in the environmental conditions.

In order to attain the aforementioned object, the present invention is directed to an ink ejection amount measurement system comprising: a recording head which ejects ink onto a recording medium by applying a drive voltage to the recording head, in such a manner that an ink dot image is formed on the recording medium; an image reading device which reads the ink dot image formed on the recording medium; a number of pixels measurement device which measures number of pixels occupied by the ink dot image formed on the recording medium; a correlation table storage device which stores a correlation table representing a correlation among a value of the drive voltage, number of pixels occupied by an ink dot image formed on the recording medium, and an ink ejection amount ejected by the recording head; a drive voltage sweeping device which changes a value of the drive voltage applied to the recording head, from a first drive voltage measurement value which is a value of the drive voltage when the number of pixels measured by the number of pixels measurement device is a first number of pixels, to a second drive voltage measurement value which is a value of the drive voltage at a boundary where the number of pixels measured by the number of pixels measurement device changes from the first number of pixels to a second number of pixels; and an ink ejection amount calculation device which calculates the ink ejection amount when a drive voltage having the first drive voltage measurement value is applied to the recording head, according to the correlation table, using the first drive voltage measurement value and the second drive voltage measurement value.

According to this aspect of the present invention, the drive voltage is changed in such a manner that the number of pixels changes from a first number of pixels to a second number of pixels, and the actual ink ejection amount when the drive voltage before change is applied is calculated by means of a previously created correlation table, using the drive voltage values before and after change. Therefore, it is possible to measure the ink ejection amount with good accuracy, even using an image reading device of essentially low resolution in an inexpensive system.

In the drive voltage sweeping step, the drive voltage is changed in increments of a prescribed amount, from the first drive voltage measurement value, ink is ejected onto the recording medium each time the drive voltage is changed, the ink dot image formed on the recording medium is read in by the image reading device, and the number of pixels occupied by the ink dot image is measured. Thereupon, this sequence of operations is repeated until the number of pixels changes from a first number of pixels to a second number of pixels.

Furthermore, in the calculation of the ink ejection amount calculation step, if the first drive voltage measurement value, which is the value of the drive voltage when the actually measured number of pixels is a first number of pixels, is taken to be $V_0$, the theoretical boundary drive voltage, which is the theoretical value of the drive voltage in the boundary region where the number of pixels theoretically changes from the first number of pixels to the second number of pixels, is taken to be $V_{pixel}$, and the drive voltage in the boundary region where the measured number of pixels actually changes from the first number of pixels to the second number of pixels, is taken to be $V_{measure}$, then the apparent drive voltage value V can be determined from the formula $V=V_0-(V_{measure}-V_{pixel})$, and using this apparent drive voltage value V and the ink ejection amount, the actual ink ejection amount when the first drive voltage measurement value $V_0$ is applied as the drive voltage value can be determined from the correlation table.

Furthermore, it is also possible to substitute, in the correlation table, the "ink droplet volume" for the "ink ejection amount", or to create both "ink ejection amount" and "ink droplet volume" in the correlation table.

Preferably, the ink ejection amount measurement system further comprises a recording medium type determination device which determines a type of the recording medium, wherein the correlation table storage device stores the correlation table in accordance with the type of the recording medium determined by the recording medium type determination device.

According to this aspect of the present invention, since a correlation table is created in accordance with the type of the recording medium, then it is possible to measure the ink ejection amount with good accuracy, in accordance with change in the environmental conditions.

Preferably, the ink ejection amount measurement system further comprises a recording head temperature determination device which determines temperature of the recording head, wherein the correlation table storage device stores the correlation table in accordance with the temperature of the recording head determined by the recording head temperature determination device.

According to this aspect of the present invention, since a correlation table is created in accordance with the temperature of the recording head, then it is possible to measure the ink ejection amount with good accuracy, in accordance with change in the environmental conditions.

According to the present invention, it is possible to measure the ink ejection amount accurately, without requiring a calibration curve or a test pattern, even using a scanner or CCD camera of essentially low resolution in an inexpensive system.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 8 is a diagram showing one example of a table of the correlation among the drive voltage, the droplet volume, the number of pixels and the dot diameter;

FIG. 14 is a diagram showing a table of the correlation between the drive voltage and the droplet volume;

FIG. 17 is a diagram showing a table of the correlation between the drive voltage and the droplet volume;

FIG. 20 is a diagram showing a table of the correlation between the drive voltage and the droplet volume;

DETAILED DESCRIPTION OF THE PREFERRED EMBODIMENTS

Description of Ink Ejection Amount Measurement System

Figure 1:
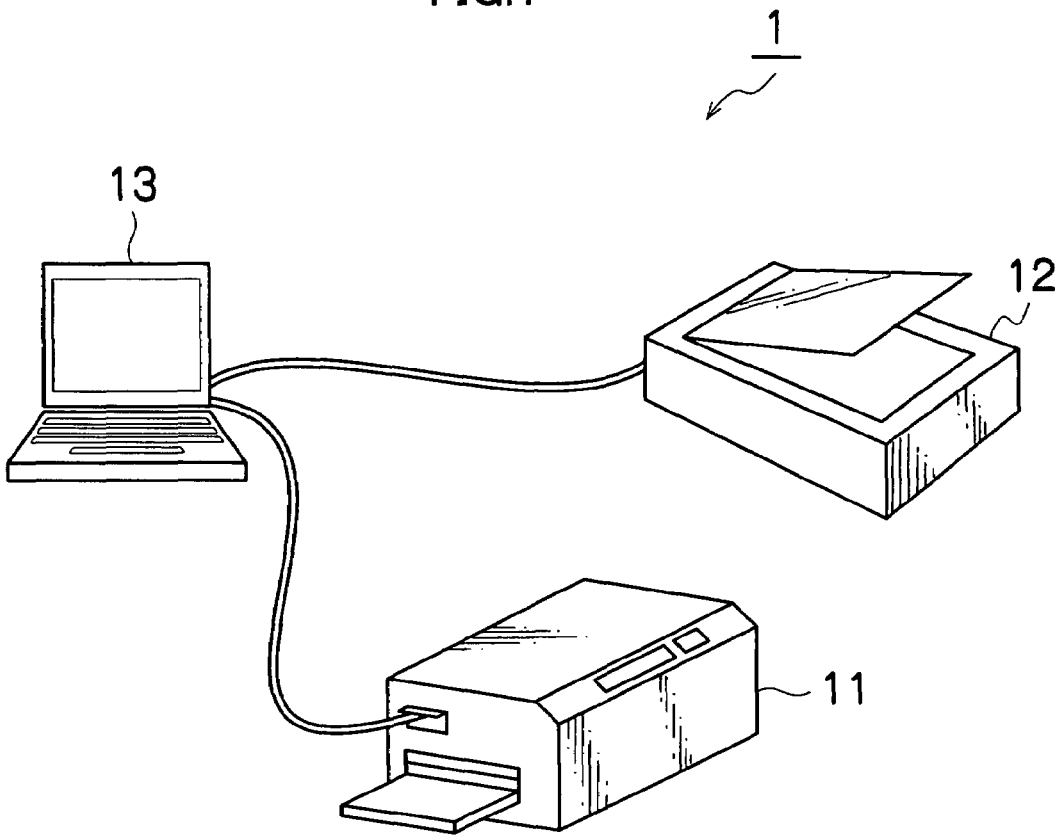
FIG. 1 is a conceptual diagram showing the general composition of an ink ejection amount measurement system according to an embodiment of the present embodiment.

FIG. 1 is a diagram showing the general composition of an ink ejection amount measurement system according to an embodiment of the present invention. As shown in FIG. 1, the ink ejection amount system 1 comprises: an inkjet recording apparatus 11 forming an image forming apparatus including a recording head, a conveyance device, a control unit, and the like; a scanner 12 forming an image reading device; a host computer 13 forming an image processing device; and the like. The constituent devices are mutually connected by lines.

The resolution of the scanner 12 does not have to be high resolution, and a general commercial scanner may be used. However, it is desirable that the resolution should be equivalent to the size of the ink droplets. For example, in the case of a dot size of 30 μm (ink droplet volume=2 pl), it is desirable to use a scanner having a resolution of not less than 4800 dpi (=5 μm or less).

Correlations Between Values

Before entering into a description of the concrete ink ejection amount measurement method used in the ink ejection amount measurement system according to the present embodiment, a general explanation is given with respect to the relationship between the ink dot size on the recording medium and the pixel data (a pixel region) read in by the scanner; the relationship between the drive waveform which drives the ink ejection actuators in the recording head and the ink ejection amount; and the relationship between the voltage of the drive waveform and the pixel data (number of pixels) read in by the scanner.

Figure 2:
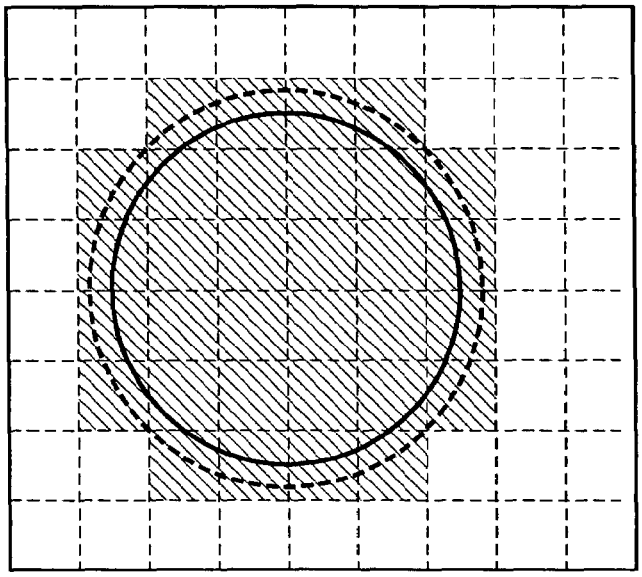
FIG. 2 is a conceptual diagram showing pixel data (a pixel region) read in by a scanner.

FIG. 2 is a conceptual diagram of pixel data (a pixel region) read in by the scanner. The region indicated by the dotted line is the original ejection region of an ink dot created by a drive voltage, and the region indicated by the solid line is the ink dot ejection region in a case where there is a change in the ink ejection amount due to the effects of the structure of the recording head and external disturbance (due to dirt or mist in the vicinity of the nozzle, for example), and the portion indicated by the hatching is the pixel data (number of pixels) read in by the scanner.

In FIG. 2, as to the image data (number of pixels) read in by the scanner, there is no difference between the original ejection region of an ink dot created by a drive voltage, and the ejection region of an ink dot in a case where there is a change in the ink ejection amount.

Figure 3:
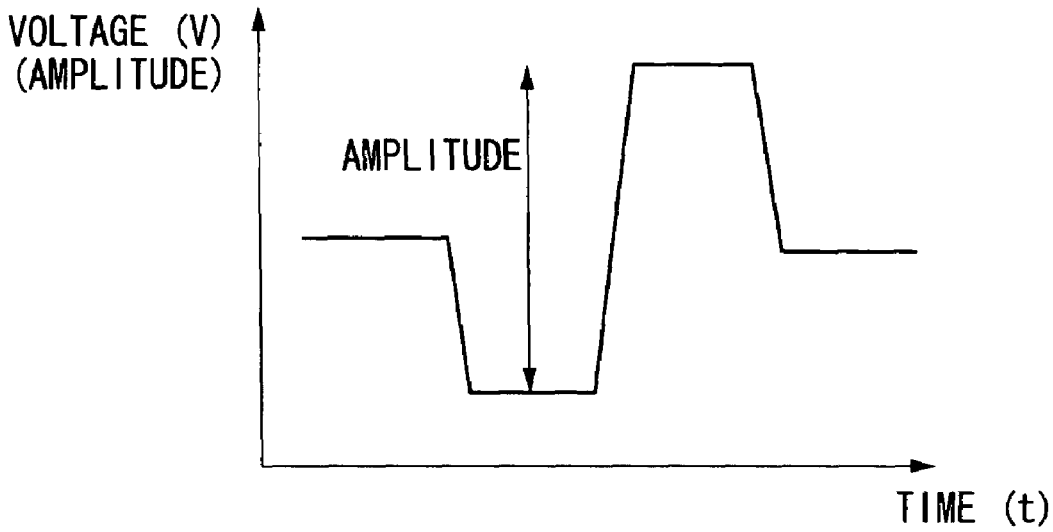
FIG. 3 is a diagram showing a drive waveform which drives an ink ejection actuator provided in a recording head.
Figure 4:
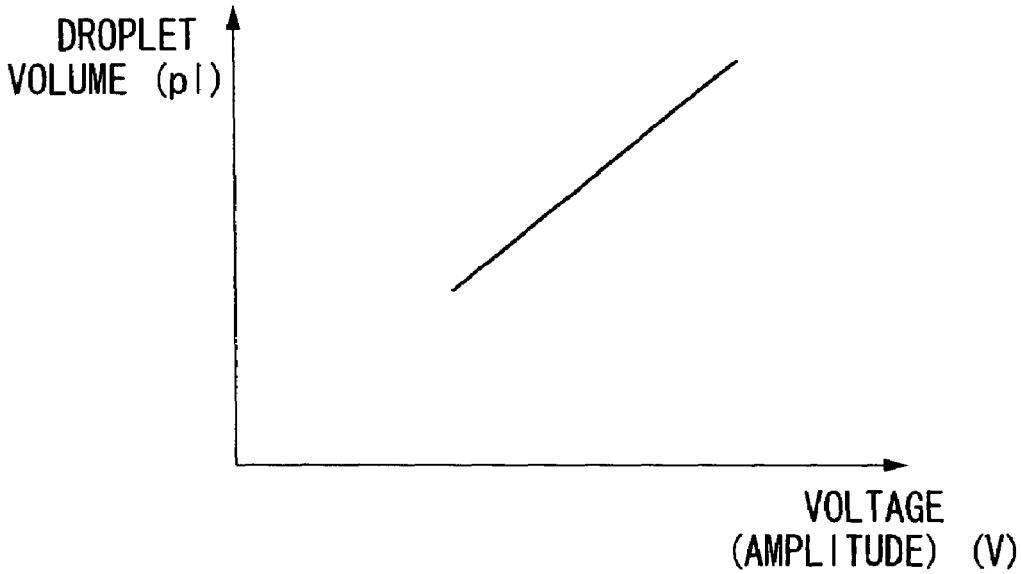
FIG. 4 is a diagram showing a graph of the correlation between the voltage of the drive waveform and the ink droplet volume.
Figure 5:
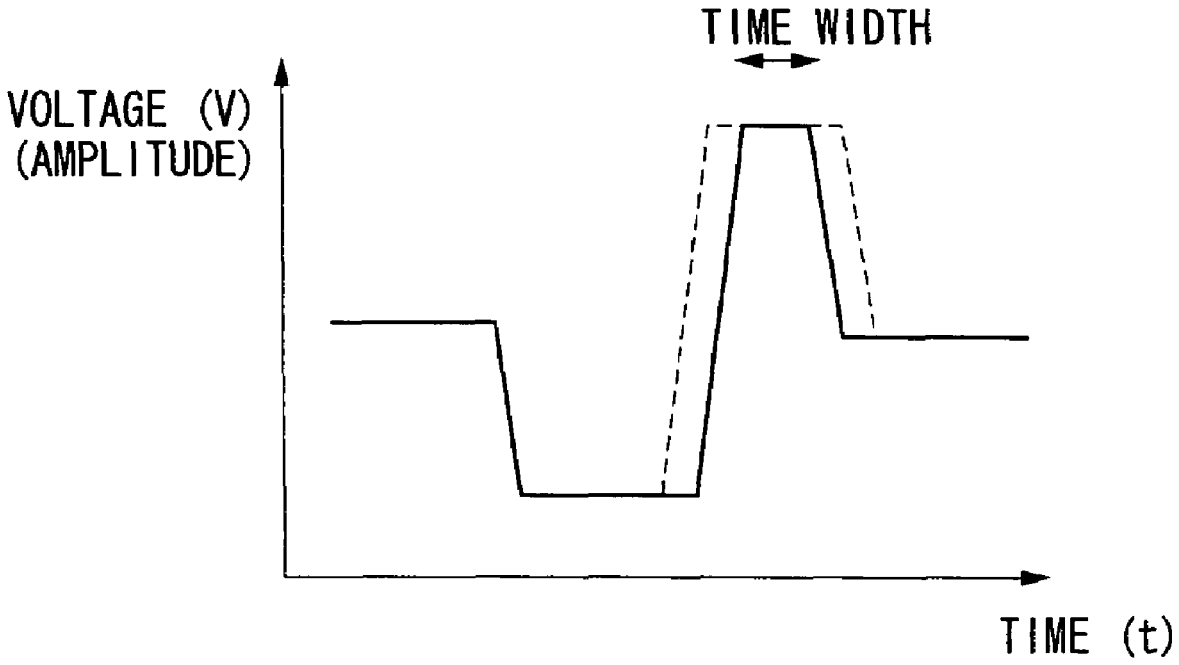
FIG. 5 is a diagram showing a drive waveform which drives an ink ejection actuator provided in a recording head.

Furthermore, FIG. 3 shows a drive waveform which drives an ink ejection actuator provided in a recording head, and FIG. 4 is a graph of the correlation between the voltage of the drive waveform and the ink droplet volume. As shown in FIG. 3 and FIG. 4, the ink droplet volume depends on and is directly proportional to the amplitude of the drive waveform. FIG. 5 shows a drive waveform which drives an ink ejection actuator provided in the recording head, and according to the graph, the ink droplet volume also changes with the time width of the drive waveform.

Figure 6A:
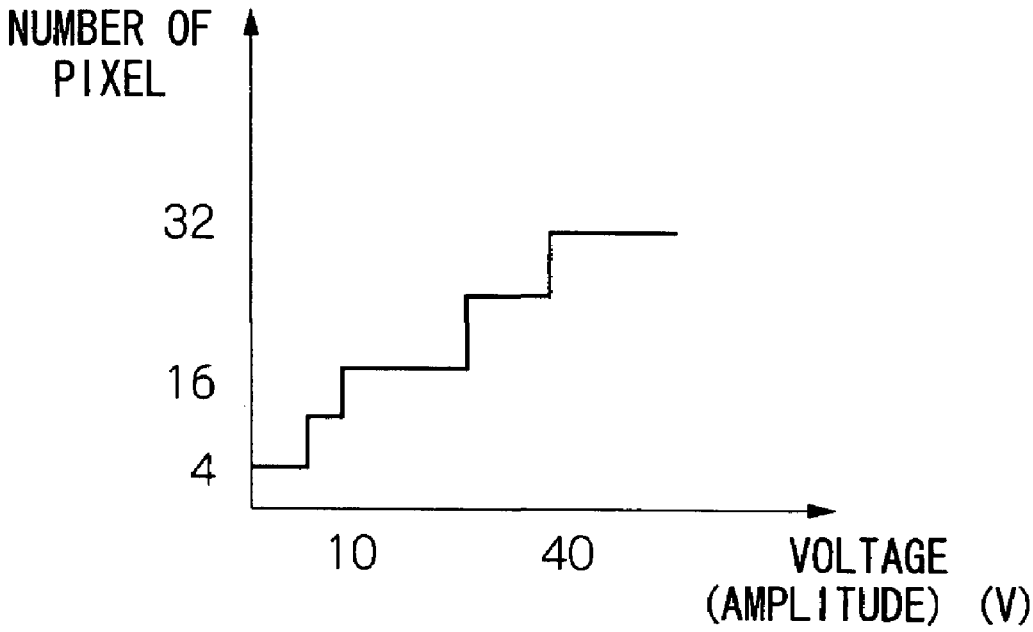
FIGS. 6A and 6B are diagrams showing the relationship between the voltage (amplitude) of a drive waveform and pixel data (number of pixels) read by a scanner.
Figure 6B:
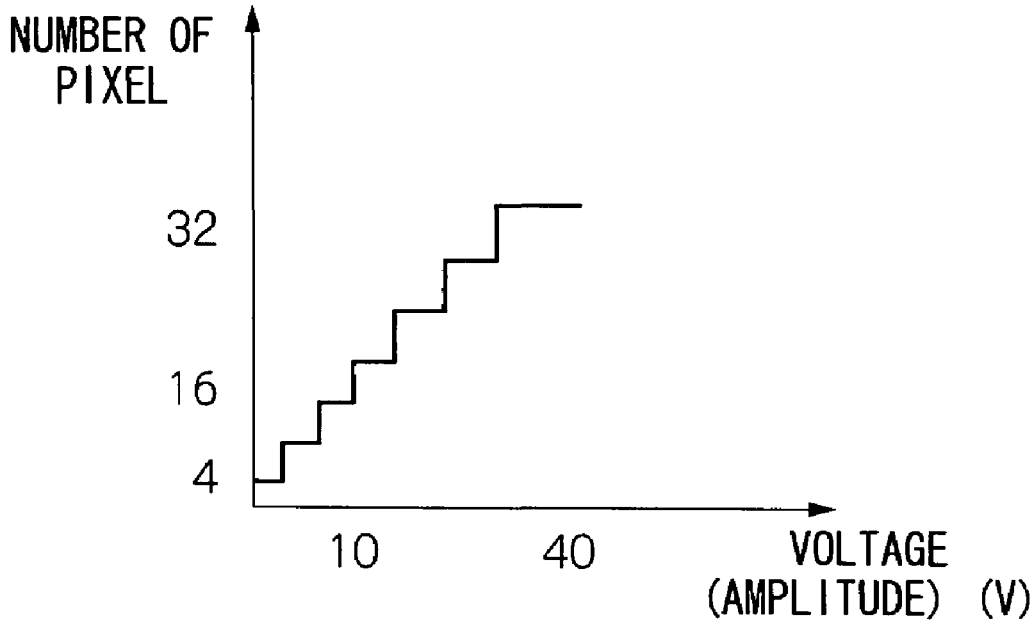

FIGS. 6A and 6B show the relationship between the voltage (amplitude) of a drive waveform and pixel data (number of pixels) read by the scanner, and FIG. 6B shows a case where the scanner resolution is higher than in FIG. 6A. As shown in FIGS. 6A and 6B, the graph indicating the relationship in the case of higher scanner resolution has a finer step shape than that in the case of lower scanner resolution.

Method of Measuring Ink Ejection Amount

In the ink ejection amount measurement system 1 according to the present embodiment, the ink ejection amount is measured by means of the following method.

Firstly, image data is output to the control unit of the inkjet recording apparatus 11 from the host computer 13. Thereupon, drive waveform data for the actuators of the recording head 16 is generated by the control unit of the inkjet recording apparatus 11, and the recording head 16 is caused to eject ink having an ink ejection amount corresponding to the generated drive waveform data onto the recording paper 14 forming the recording medium. Subsequently, the dot diameter of one ink dot printed onto the recording paper 14 is read in by the scanner 12. The recording paper 14 may be a medium such as printing paper, or it may be a glass substrate. The detailed composition of the control unit of the inkjet recording apparatus 11 and the recording head 16 are described hereinafter.

Figure 7:
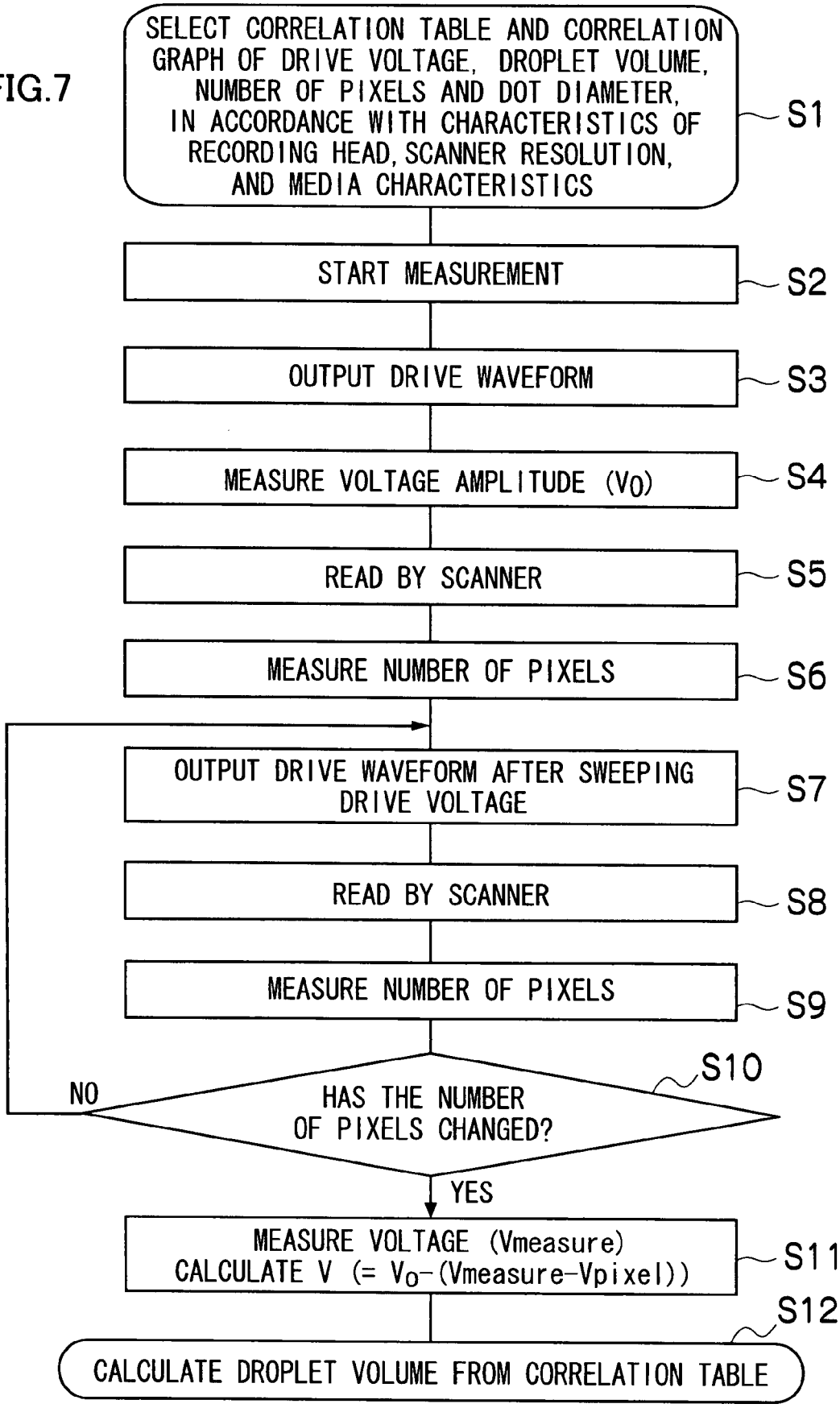
FIG. 7 is a flowchart diagram showing a method of measuring the ink ejection amount.

FIG. 7 is a flowchart diagram showing a method of measuring the ink ejection amount. Firstly, a correlation table and/or a correlation graph are selected in advance which associate the drive voltage, the droplet volume, and the number of pixels, in accordance with the characteristics of the recording head 16, the resolution of the scanner 12, and the characteristics of the recording paper 14 (step S1). Since the drive voltage and the droplet volume data vary with the media used for printing, this data is created for each type of media. Furthermore, the droplet volume varies with the ink temperature, and therefore droplet volume data is created for each temperature.

Figure 9:
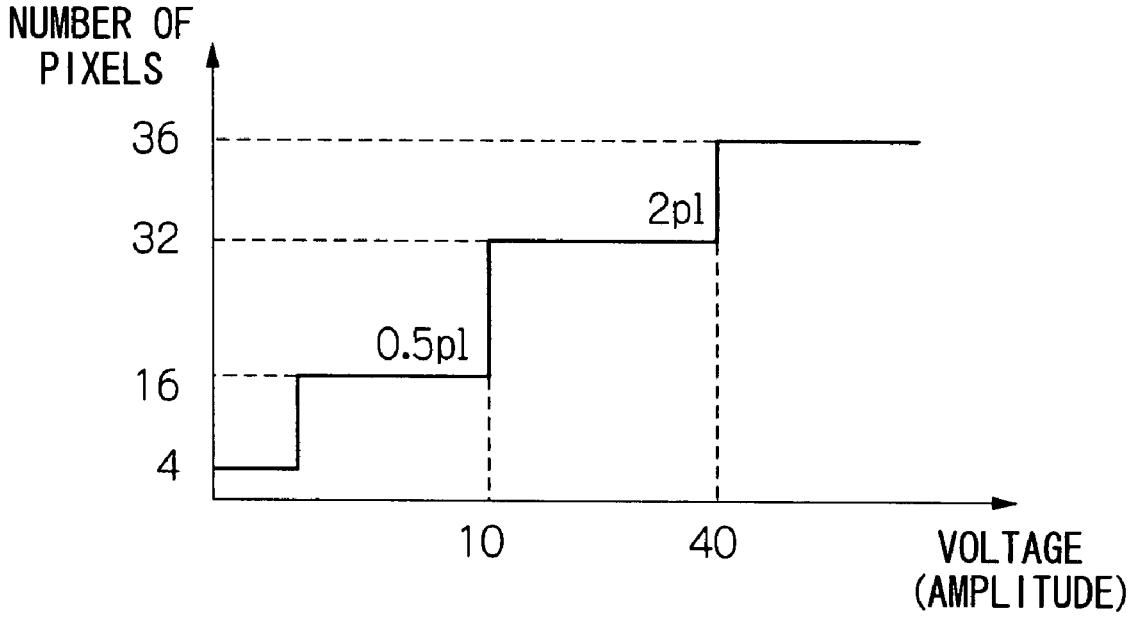
FIG. 9 is a diagram showing one example of a graph of the correlation between the drive voltage and the number of pixels.

Here, FIG. 8 shows one example of a table of the correlation between the drive voltage, the droplet volume, the number of pixels and the dot diameter, and FIG. 9 shows one example of a graph of the correlation between the drive voltage and the number of pixels. The correlation table in FIG. 8 and the correlation graph in FIG. 9 are necessary when calculating the ink ejection amount, as described hereinafter, and therefore it is particularly necessary to determine the voltage and the droplet volume at the time that the number of pixels changes.

Next, measurement is started (step S2), a drive waveform is output to an actuator of the recording head 16 described below, and an ink droplet is ejected onto the recording paper 14 (step S3). Thereupon, the voltage amplitude $V_0$ at that time is measured (step S4), the ink dot image formed on the recording paper 14 is read in by the scanner 12 (step S5), and the number of pixels is measured (step S6). Here, it is presumed that the image processing is based on a binarization process.

Thereupon, the value of the drive voltage is changed (swept) and a drive waveform is output (step S7). In the present embodiment, the amount of change in the drive voltage (sweep increment) is set to approximately 1V. The ink dot image formed on the recording paper 14 is read in by the scanner 12 (step S8), and the number of pixels is measured (step S9). Thereupon, it is determined whether or not there is a change in the number of pixels measured at step S9 with respect to the number of pixels measured at step S6 (step S10).

If it is judged that the number of pixels has not changed, then the procedure returns to step S7. On the other hand, if it is judged that the number of pixels has changed, then the droplet volume and the ink ejection amount are calculated from the correlation table, on the basis of the value of the drive voltage at the time that it was judged that the number of pixels had changed (step S11 and S12).

Figure 10:
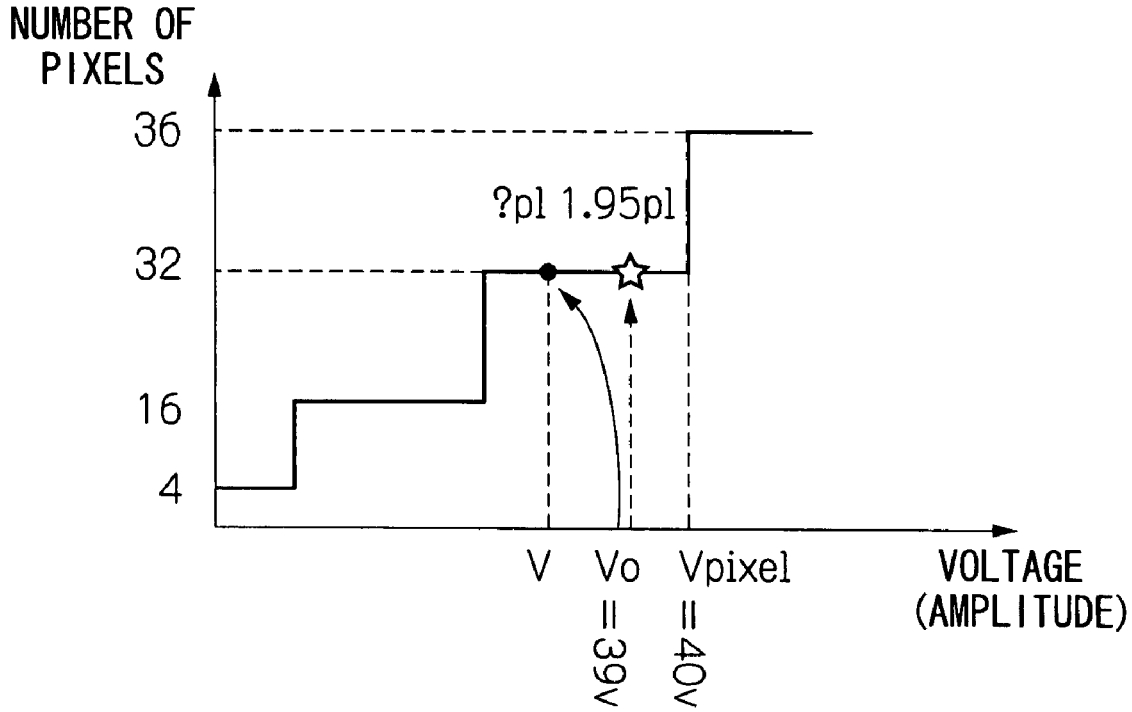
FIG. 10 is a conceptual diagram of the drive voltage when there is variation in the ink droplet volume.
Figure 11:
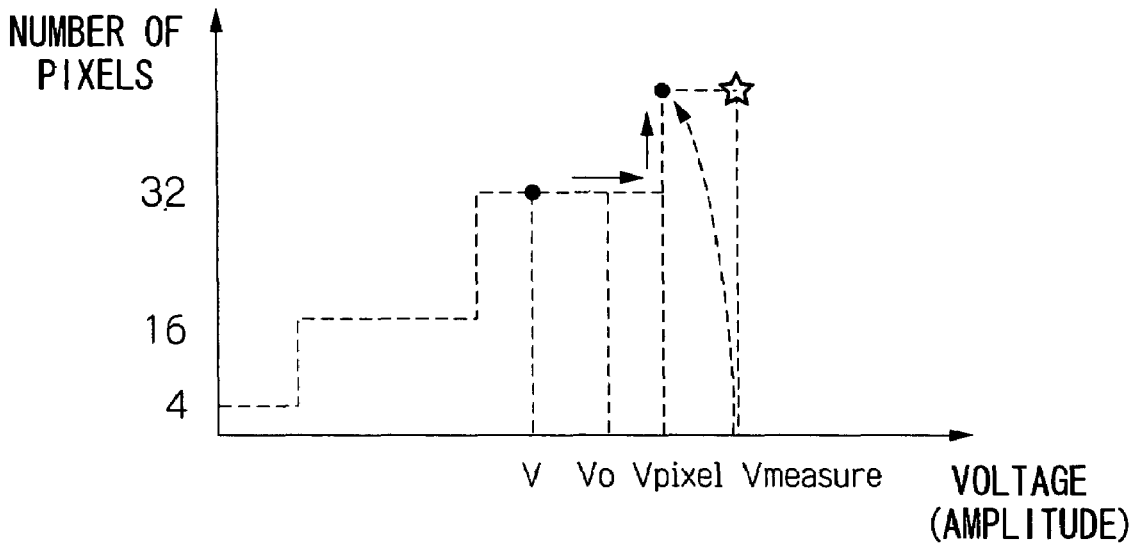
FIG. 11 is a conceptual diagram of a method of sweeping the drive voltage when there is variation in the ink droplet volume.

FIG. 10 is a conceptual diagram of the drive voltage in a case where the ink droplet volume varies, and FIG. 11 is a conceptual diagram of a method of sweeping the drive voltage in a case where the ink droplet volume varies.

In principle, in a theoretical state, an ink droplet of 1.95 pl (see the star symbol in FIG. 10) is ejected, as a theoretical value corresponding to a drive voltage of $V_0$=39V. However, it is supposed that the actual volume of the ink droplet varies due to an external disturbance of some kind (see the black circle symbol in FIG. 10). In this case, even if it is sought to determine the varied droplet volume, from the number of pixels in the ink dot output by the scanner 12, the number of pixels will remain the same value of "32", and therefore it is not possible to determine the actual droplet volume from the result relating to the number of pixels. In FIG. 10, the apparent drive voltage which corresponds to the actual droplet volume is taken to be V.

Therefore, in the present embodiment, the apparent drive voltage V which corresponds to the actual droplet volume is found from the drive voltage $V_0$ and the original drive voltage $V_{pixel}$ at which the number of pixels should change (the drive voltage $V_0$ and the original drive voltage $V_{pixel}$ are known values). Thereby, the actual droplet volume after variation, and hence the actual ink ejection amount, are determined.

More specifically, the amplitude of the drive voltage is changed (swept) until the number of pixels read by the scanner 12 changes, the voltage $V_{measure}$ at which the number of pixels changed is measured, and the voltage V is determined by means of the following formula.

$$V=V_0-(V_{measure}-V_{pixel}) \quad \text{Formula 1}$$

Figure 12:
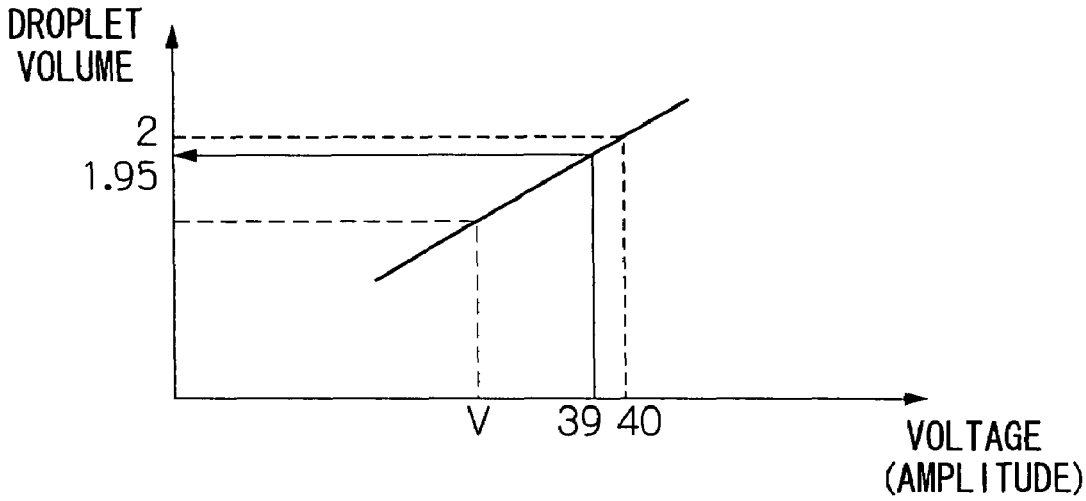
FIG. 12 is a diagram showing a graph of the correlation between the voltage of the drive waveform and the droplet volume.

Thereupon, the droplet volume corresponding to the determined value of V is found by means of the graph indicating the correlation between the voltage of the drive waveform and the droplet volume as shown in FIG. 12.

Desirably, correlation tables are created in accordance with the types of recording paper 14 or in accordance with the temperature of the recording head 16. In the present embodiment, an optical sensors 23 and a temperature sensor 24 are attached to each of the recording heads 16K, 16C, 16M and 16Y, in such a manner that the type of recording paper 14 is identified, and the temperature of the recording head 16 at the time of ejection is read in.

Here, a description is given below using concrete values. Firstly, ink is ejected onto the recording paper 14 by applying a drive voltage of 39V to the recording head 16. Thereupon, the ink dot image formed on the recording paper 14 is read in by the scanner 12 and the number of pixels in the image is measured. Here, as shown in FIG. 10, the number of pixels measured when the drive voltage is 39V is taken to be 32.

Thereupon, the drive voltage is swept by 1V from 39V so as to apply a drive voltage of 40V to the recording head 16, and in a similar fashion, the number of pixels in the ink dot image is measured. Here, as shown in FIG. 10, it is supposed that the number of pixels measured when the drive voltage is 40V remains at a value of 32. Referring to the correlation graph in FIG. 8, the theoretical number of pixels when the drive voltage is 40V ought to have changed from 32 to 36. However, the actually measured number of pixels remains at 32. Therefore, at this point, the measurement operator recognizes that the actual ink ejection amount has become less than the originally intended ink ejection amount due to an external disturbance of some kind. Thereupon, by subsequently continuing measurement as described below, it is possible to confirm the effects on the ink ejection amount due to the external disturbance by determining the actual ink ejection amount used at a drive voltage of 39V.

Thereupon, the drive voltage is swept by 1V from 40V to apply a drive voltage of 41V to the recording head 16, and in a similar fashion, the number of pixels in the ink dot image is measured. Here, it is supposed that the number of pixels measured when the drive voltage is 41V remains at a value of 32.

Thereupon, the drive voltage is swept by 1V from 41V so as to apply a drive voltage of 42V to the recording head 16, and in a similar fashion, the number of pixels in the ink dot image is measured. Here, it is supposed that the measured number of pixels when the drive voltage is 42V has changed from 32 to 36. Consequently, although in principle, theoretically, the number of pixels ought to have changed from 32 to 36 when the drive voltage became 40V, in actual practice, the number of pixels changes from 32 to 36 when the drive voltage became 42V, which is a divergence of 2V from the theoretical value.

Thereupon, from the correlation table in FIG. 8 and the correlation graph in FIG. 9, the ink ejection amount corresponding to the apparent drive voltage value, which is 2V lower than the actual drive voltage value, is read out as the actual ink ejection amount. According to the expression in Formula 1, since $V=V_0-(V_{measure}-V_{pixel})$, then $V=39-(42-40)=37$. Consequently, it can be ascertained that the actual ink ejection amount at a drive voltage of 39V is an ink ejection amount of 1.85 pl, which corresponds to the apparent drive voltage of 37V in the correlation table in FIG. 8.

By means of the measurement method described above, even if the actual ink ejection amount is different to the originally intended ink ejection amount due to the effects of an external disturbance of some kind, it is still possible to measure the actual ink ejection amount. Therefore, by carrying out maintenance based on measuring the actual ink ejection amount from each of the nozzles during the maintenance, or the like, it is possible to stabilize the print quality.

Furthermore, in the present embodiment, the actual ink ejection amount can be measured by ascertaining the amount of deviation between the actual ink ejection amount and the originally intended ink ejection amount by sweeping the drive voltage. Therefore, it is possible to measure the actual ink ejection amount from each of the nozzles, accurately, even when using a scanner having a low resolution, such as a commercial scanner.

The ink dots produced in printing by means of an inkjet system may have a variety of different diameters. Therefore, it is desirable to use a scanner having a resolution which is suitable to the dot diameters.

Here, a scanner 12 having a resolution that is suitable to dot diameters is described below with reference to concrete examples. Firstly, the number of voltage sweeps will be considered (the number of voltage sweeps being the number of repetitions of an operation of applying a drive voltage to the recording head 16 to eject ink from the recording head 16, and then applying a subsequent drive voltage increased by a voltage increment, to the recording head 16, and thereby ejecting ink from the recording head 16). The voltage sweep increment is taken to be 1V per time, since an increment of approximately 1V is a suitable level for sweeping when measurement error is taken into account.

Figure 13:
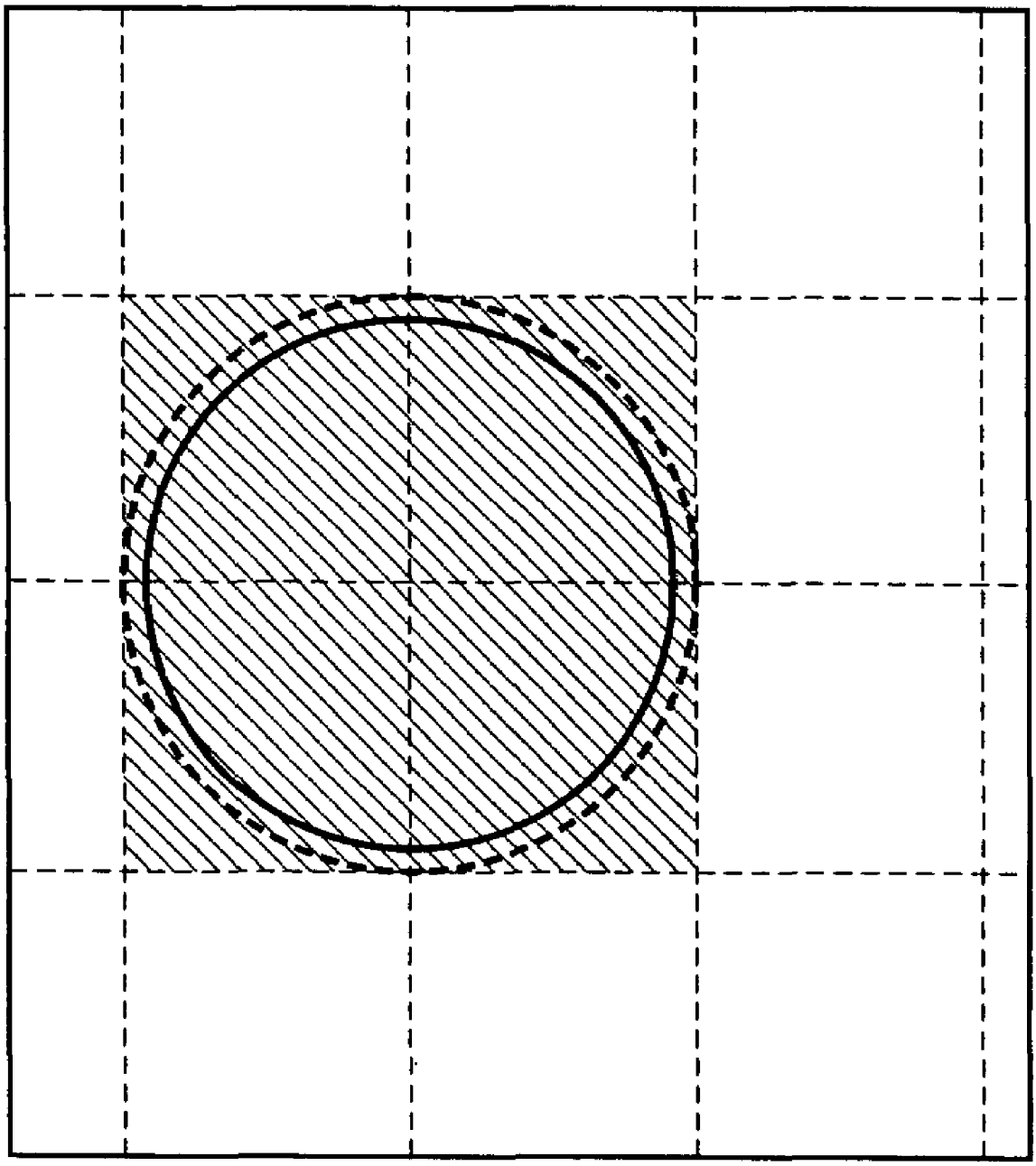
FIG. 13 is a conceptual diagram showing pixel data read in by a scanner.
Figure 15:
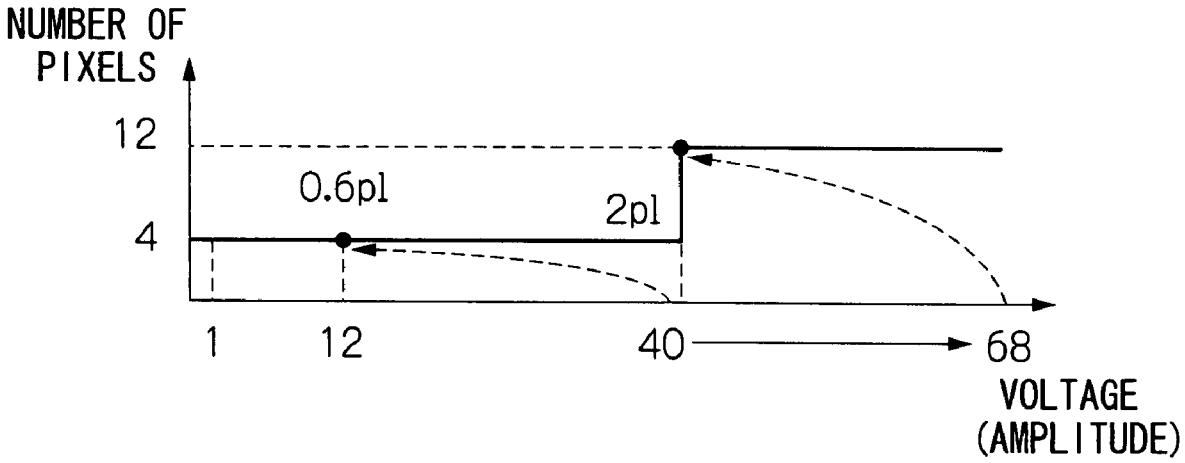
FIG. 15 is a diagram showing a graph of the correlation between the drive voltage and the image data (number of pixels) read by the scanner.

For example, a case is considered in which, in respect of a drive voltage of 40V, the originally intended droplet volume is 2 pl, but the actual droplet volume has become 0.6 pl due to external disturbance of some kind. Firstly, a case is considered in which the resolution of the scanner 12 is ½ of the diameter of the ink dot. The ink dot diameter is 30 μm, and the resolution of the scanner 12 is 15 μm (=1600 dpi). FIG. 13 is a conceptual diagram of pixel data obtained by the scanner 12 in this case, and FIG. 14 shows a correlation table of drive voltage and droplet volume. Furthermore, FIG. 15 is a graph of the correlation between the drive voltage and the image data (number of pixels) from the scanner 12.

As shown in FIG. 13, when a drive voltage of 40V is applied, the droplet volume becomes less than the originally intended droplet volume due to an external disturbance of some kind, and the ejection region in the case of the actual droplet volume which is indicated by the solid line becomes less than the ejection region in the case of the originally intended droplet volume, which is indicated by the broken line. In this case, the number of pixels recognized by the scanner 12 is 4.

Therefore, if the drive voltage is swept progressively in 1V increments from 40V, then the number of pixels remains at 4 for some time. Thereupon, when the drive voltage reaches 68V, the number of pixels finally increases from 4 to 12, which is the increase that should have occurred when the drive voltage was 40V. Consequently, as shown in FIG. 15, after starting from a drive voltage of 40V, a total of 28 sweeps are required until the number of pixels count increases.

Figure 16:
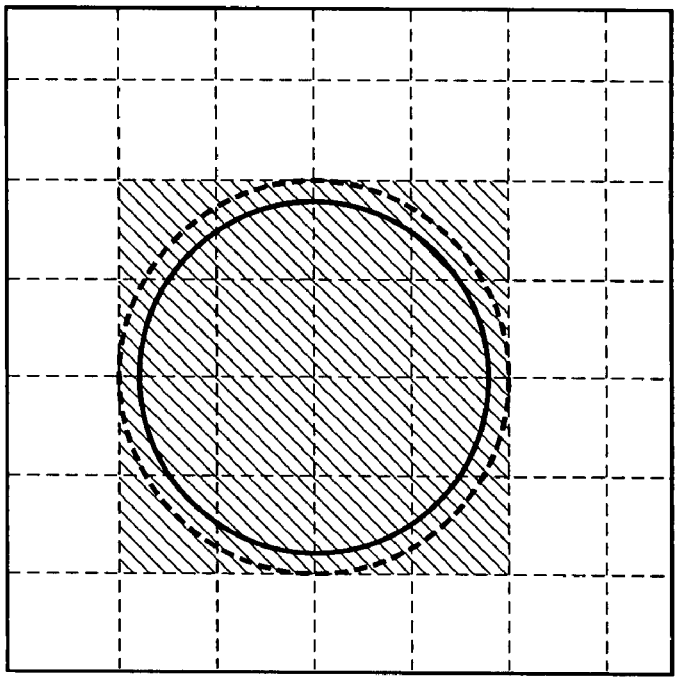
FIG. 16 is a conceptual diagram showing pixel data read in by a scanner.
Figure 18:
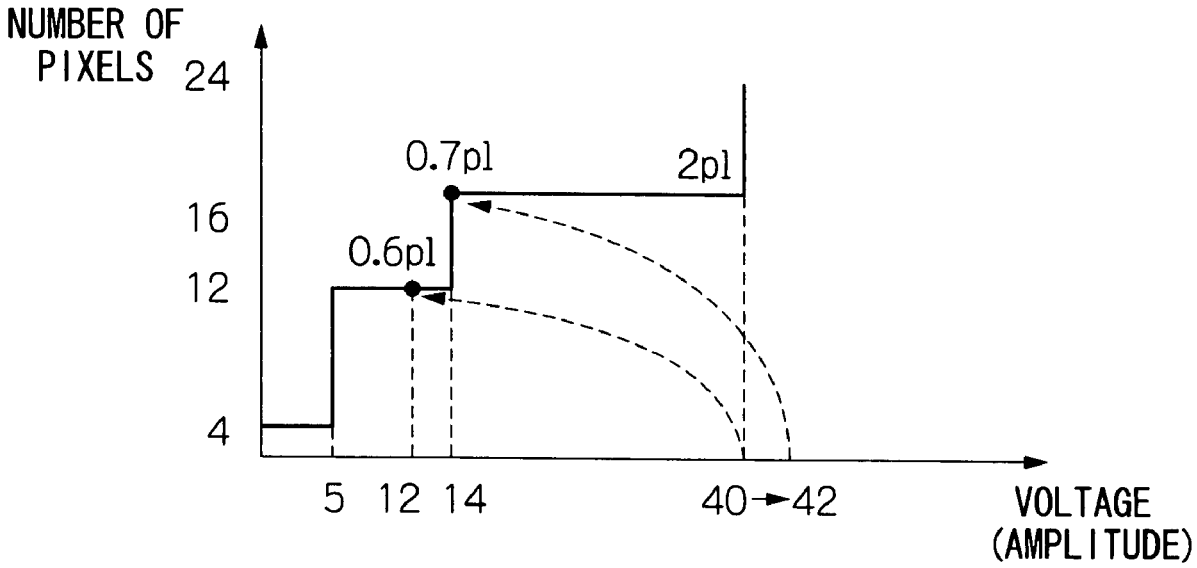
FIG. 18 is a diagram showing a graph of the correlation between the drive voltage and the image data (number of pixels) read by the scanner.

Next, a case is considered in which the resolution of the scanner 12 is ¼ of the diameter of the ink dot. The ink dot diameter is 30 μm, and the resolution of the scanner 12 is 7 μm (=3600 dpi). FIG. 16 is a conceptual diagram of pixel data obtained by the scanner 12 in this case, and FIG. 17 shows a correlation table of drive voltage and droplet volume. Furthermore, FIG. 18 is a graph of the correlation between the drive voltage and the image data (number of pixels) from the scanner 12.

As shown in FIG. 16, when a drive voltage of 40V is applied, the droplet volume becomes less than the originally intended droplet volume due to an external disturbance of some kind, and the ejection region in the case of the actual droplet volume which is indicated by the solid line becomes less than the ejection region in the case of the originally intended droplet volume, which is indicated by the broken line. In this case, the number of pixels recognized by the scanner 12 is 16.

In such a case, if the drive voltage is swept in increments of 1V from 40V, then although the number of pixels remains at 4 at a drive voltage of 41V, the number of pixels increases from 16 to 24 when the drive voltage reaches 42V. Consequently, as shown in FIG. 18, after starting from a drive voltage of 40V, only 2 sweeps are required until the number of pixels count increases.

Figure 19:
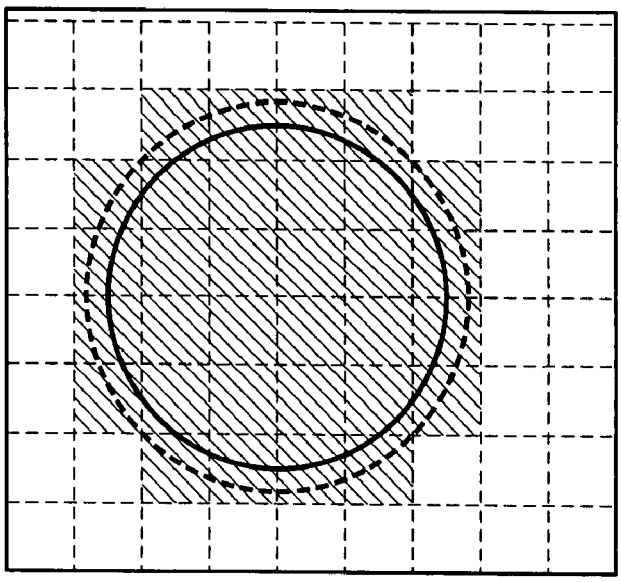
FIG. 19 is a conceptual diagram showing pixel data read in by a scanner.
Figure 21:
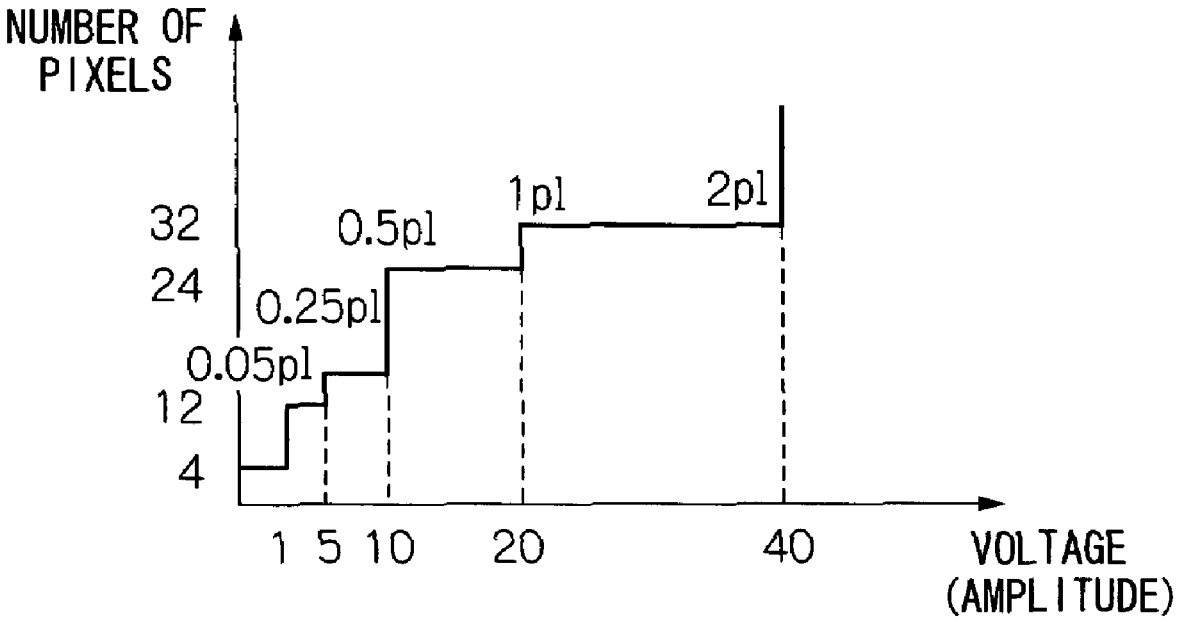
FIG. 21 is a diagram showing a graph of the correlation between the drive voltage and the image data (number of pixels) read by the scanner.

Next, a case is considered in which the resolution of the scanner 12 is ⅙ of the diameter of the ink dot. The ink dot diameter is 30 μm, and the resolution of the scanner 12 is 5 μm (=4800 dpi). FIG. 19 is a conceptual diagram of pixel data obtained by the scanner 12 in this case, and FIG. 20 shows a table of the correlation between drive voltage and droplet volume. Furthermore, FIG. 21 is a graph of the correlation between the drive voltage and the image data (number of pixels) from the scanner 12.

As shown in FIG. 19, when a drive voltage of 40V is applied, the droplet volume becomes less than the originally intended droplet volume due to an external disturbance of some kind, and the ejection region in the case of the actual droplet volume which is indicated by the solid line becomes less than the ejection region in the case of the originally intended droplet volume, which is indicated by the broken line. In this case, the number of pixels recognized by the scanner 12 is 32.

In such a case, if the drive voltage is swept progressively in 1V increments from 40V, then the number of pixels remains at 32 for a while. Thereupon, when the drive voltage reaches 48V, the number of pixels finally increases from 32 to 36, which is the increase that should have occurred when the drive voltage is 40V. Consequently, as shown in FIG. 21, after starting from a drive voltage of 40V, a total of 8 sweeps are required until the number of pixels count increases.

From the results above, it can be seen that the higher the resolution, the lower the number of sweeps of the drive voltage. Furthermore, in a case where the resolution of the scanner 12 is too low, such as 15 μm (=1600 dpi), then it is necessary for the drive voltage to be raised until 68V in order to raise the count of the number of pixels by sweeping the drive voltage. Therefore, taking account of the drive voltage, it is necessary for the minimum resolution of the scanner 12 to be equal to or greater than the absolute rating (absolute maximum rating) of the drive transistor. In this case, the voltage is a maximum of 40V+39V sweep=79V Max.

The rating of the high-voltage and high-current power transistors used in the drive circuitry of the inkjet system is around 40 to 60V. Consequently, it is desirable that the swept drive voltage should be within this rating. Consequently, the resolution of the scanner 12 should desirably be approximately ⅓ or ¼ of the diameter of the ink dot.

Composition of Inkjet Recording Apparatus

Next, an inkjet recording apparatus is described as a concrete example of the application of an image forming apparatus having the ink ejection amount measurement function described above.

Figure 22:
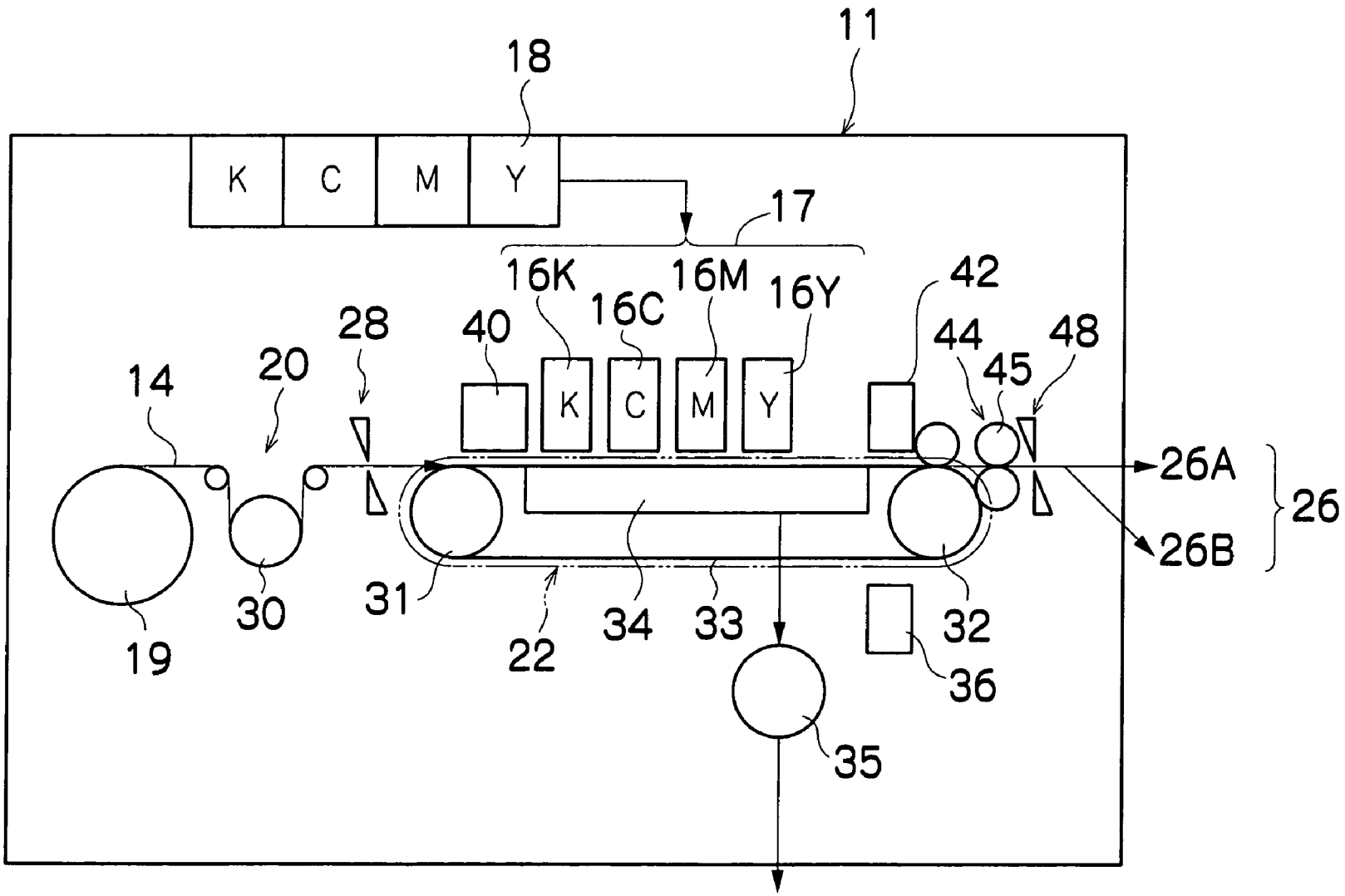
FIG. 22 is a general schematic drawing of an inkjet recording apparatus which forms one embodiment of an image forming apparatus relating to the present invention.

FIG. 22 is a general schematic drawing of an inkjet recording apparatus which forms one embodiment of an image forming apparatus relating to the present invention. As shown in FIG. 22, the inkjet recording apparatus 11 comprises: a print unit 17 having a plurality of inkjet recording heads (hereinafter, called "recording heads") 16K, 16C, 16M and 16Y provided for ink colors of black (K), cyan (C), magenta (M), and yellow (Y), respectively; an ink storing and loading unit 18 for storing inks to be supplied to the respective recording heads 16K, 16C, 16M and 16Y; a paper supply unit 19 for supplying recording paper 14, which forms a recording medium; a decurling unit 20 for removing curl in the recording paper 14; a suction belt conveyance unit 22 disposed facing the nozzle face (ink droplet ejection face) of the print unit 17, for conveying the recording paper 14 while keeping the recording paper 14 flat; and a paper output unit 26 for outputting printed recording paper (printed matter) to the exterior.

The ink storing and loading unit 18 has ink tanks for storing the inks of K, C, M and Y to be supplied to the recording heads 16K, 16C, 16M, and 16Y, and the tanks are connected to the recording heads 16K, 16C, 16M, and 16Y by means of prescribed channels.

The recording paper 14 delivered from the paper supply unit 19 retains curl due to having been loaded in the magazine. In order to remove the curl, heat is applied to the recording paper 14 in the decurling unit 20 by a heating drum 30 in the direction opposite from the curl direction in the magazine.

In the case of the configuration in which roll paper is used, a cutter (first cutter) 28 is provided as shown in FIG. 22, and the continuous paper is cut into a desired size by the cutter 28.

The decurled and cut recording paper 14 is delivered to the belt conveyance unit 22. The belt conveyance unit 22 has a configuration in which an endless belt 33 is set around rollers 31 and 32 so that the portion of the endless belt 33 facing at least the nozzle face of the print unit 17 forms a horizontal plane (flat plane).

The belt 33 has a width that is greater than the width of the recording paper 14, and a plurality of suction apertures (not shown) are formed on the belt surface. A suction chamber 34 is disposed in a position facing the nozzle surface of the print unit 17 on the interior side of the belt 33, which is set around the rollers 31 and 32, as shown in FIG. 22. The suction chamber 34 provides suction with a fan 35 to generate a negative pressure, and the recording paper 14 is held on the belt 33 by suction.

The belt 33 is driven in the clockwise direction in FIG. 22 by the motive force of a motor 88 (not shown in FIG. 22, but shown in FIG. 27) being transmitted to at least one of the rollers 31 and 32, which the belt 33 is set around, and the recording paper 14 held on the belt 33 is conveyed from left to right in FIG. 22.

Since ink adheres to the belt 33 when a marginless print job or the like is performed, a belt-cleaning unit 36 is disposed in a predetermined position on the exterior side of the belt 33 (a suitable position outside the printing area).

A heating fan 40 is disposed on the upstream side of the print unit 17 in the conveyance pathway formed by the belt conveyance unit 22. The heating fan 40 blows heated air onto the recording paper 14 to heat the recording paper 14 immediately before printing so that the ink deposited on the recording paper 14 dries more easily.

Figure 23:
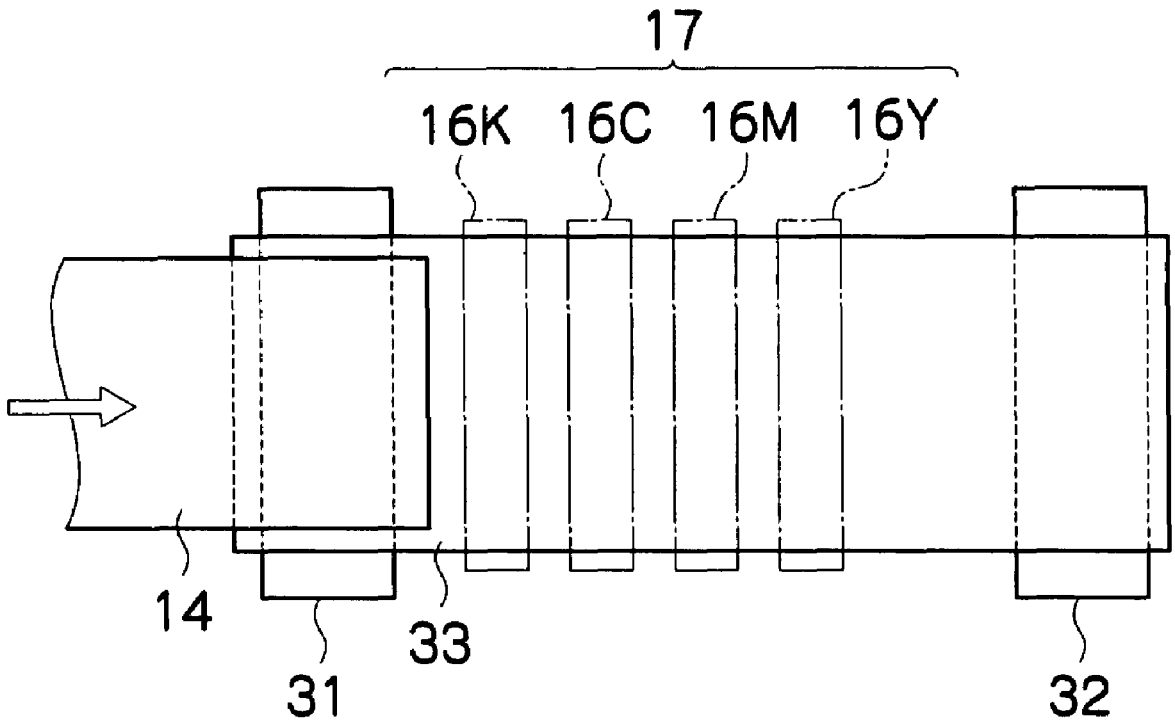
FIG. 23 is a plan view of the principal part of the peripheral area of a print unit in the inkjet recording apparatus illustrated in FIG. 22.

The recording heads 16K, 16C, 16M and 16Y of the print unit 17 are full line recording heads having a length corresponding to the maximum width of the recording paper 14 used with the inkjet recording apparatus 11, and comprising a plurality of nozzles for ejecting ink arranged on a nozzle face through a length exceeding at least one edge of the maximum-size recording medium (namely, the full width of the printable range) (see FIG. 23).

The recording heads 16K, 16C, 16M and 16Y are arranged in color order (black (K), cyan (C), magenta (M), yellow (Y)) from the upstream side in the feed direction of the recording paper 14, and each of the recording heads 16K, 16C, 16M and 16Y is fixed extending in a direction substantially perpendicular to the conveyance direction of the recording paper 14.

A color image can be formed on the recording paper 14 by ejecting inks of different colors from the recording heads 16K, 16C, 16M and 16Y, respectively, onto the recording paper 14 while the recording paper 14 is conveyed by the belt conveyance unit 22.

By adopting a configuration in which the full line recording heads 16K, 16C, 16M and 16Y having nozzle rows covering the full paper width are provided for the respective colors in this way, it is possible to record an image on the full surface of the recording paper 14 by performing just one operation of relatively moving the recording paper 14 and the print unit 17 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Figure 27:
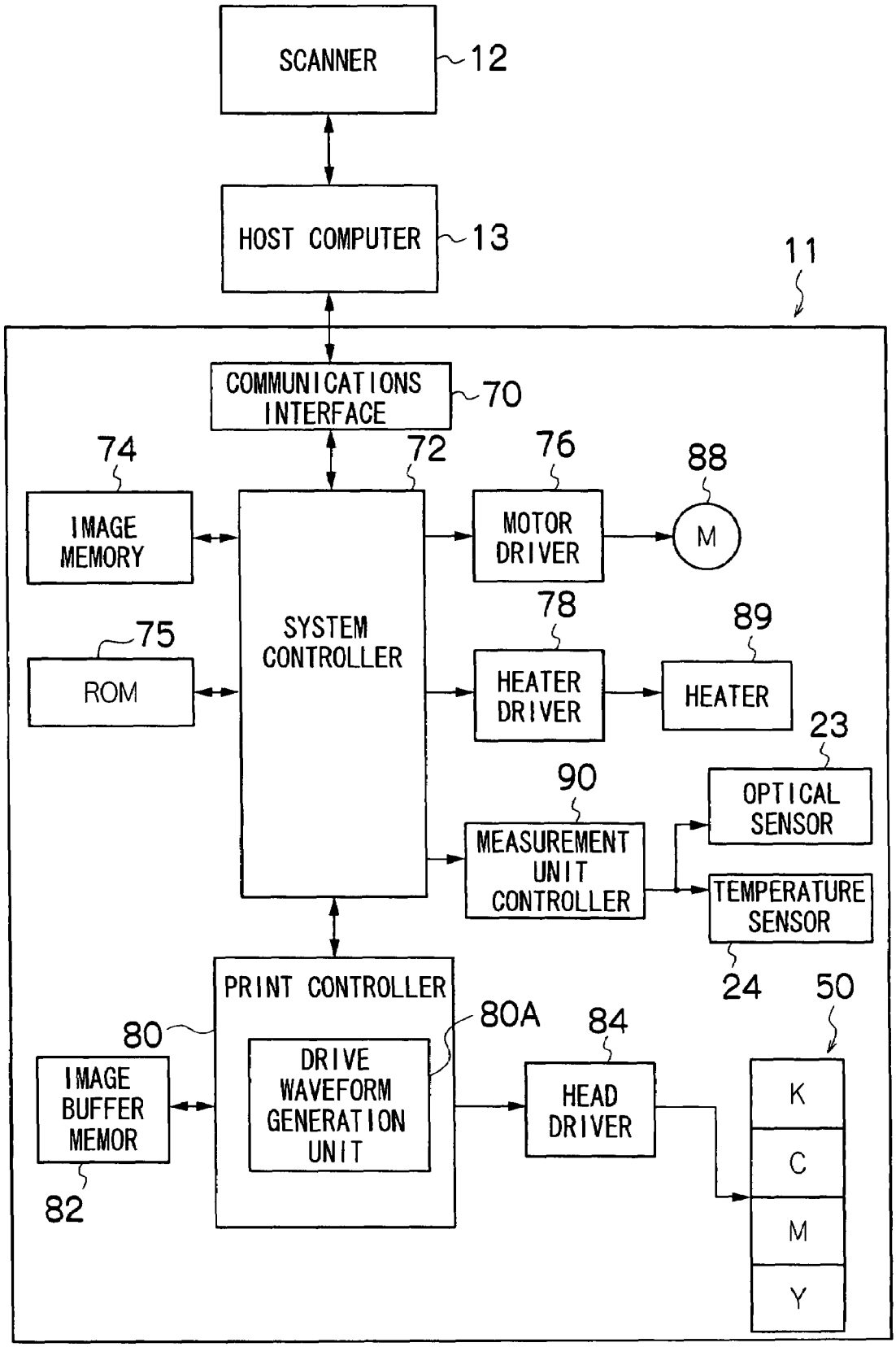
FIG. 27 shows a block diagram showing the system composition of the inkjet recording apparatus.

Furthermore, an optical sensor 23 and a temperature sensor 24 are attached to each of the recording heads 16K, 16C, 16M and 16Y. The optical sensor 23 recognizes the type of recording paper 14 by emitting light toward the recording paper 14 from a light emitting section and receiving the amount of light reflected by the recording paper 14 in a light receiving section. The temperature sensor reads in the temperature of the recording head 16 upon ejection. The analog data from the optical sensor 23 and the temperature sensor is digitalized by an AD converter, and as shown in FIG. 27 described below, this data is input to the CPU of the system controller 72, which recognizes the type of the recording paper 14, as well as reading the temperature of the recording head 16 upon ejection.

A post-drying unit 42 is disposed following the print unit 17. A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. In the inkjet recording apparatus 11, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48.

Structure of the Recording Head

Next, the structure of the recording heads is described below. The recording heads 16K, 16C, 16M and 16Y of the respective ink colors have the same structure, and a reference numeral 50 is hereinafter designated to any of the recording heads.

Figure 24A:
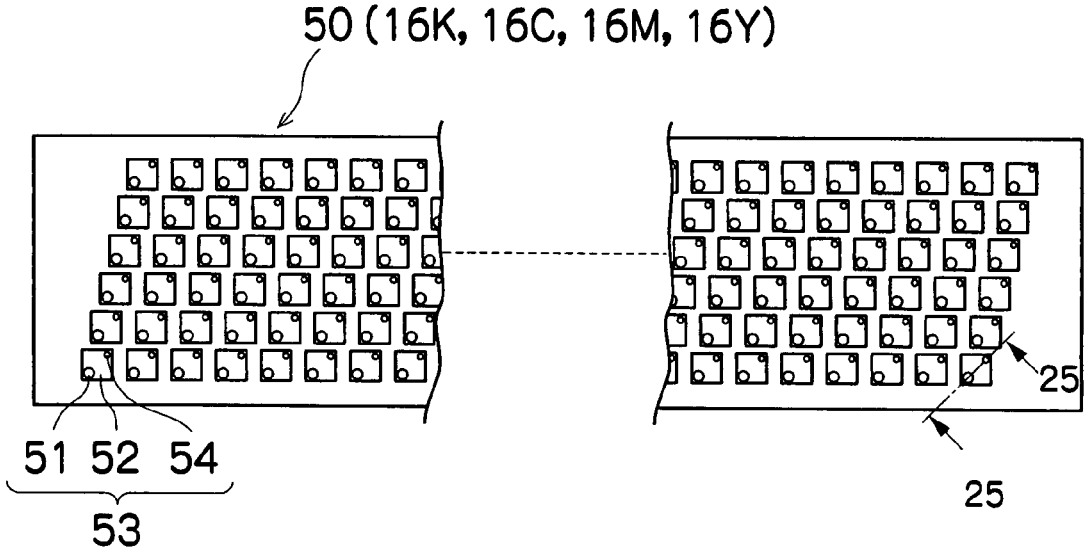
FIG. 24A is a plan view perspective diagram showing an example of the composition of a recording head.
Figure 24B:
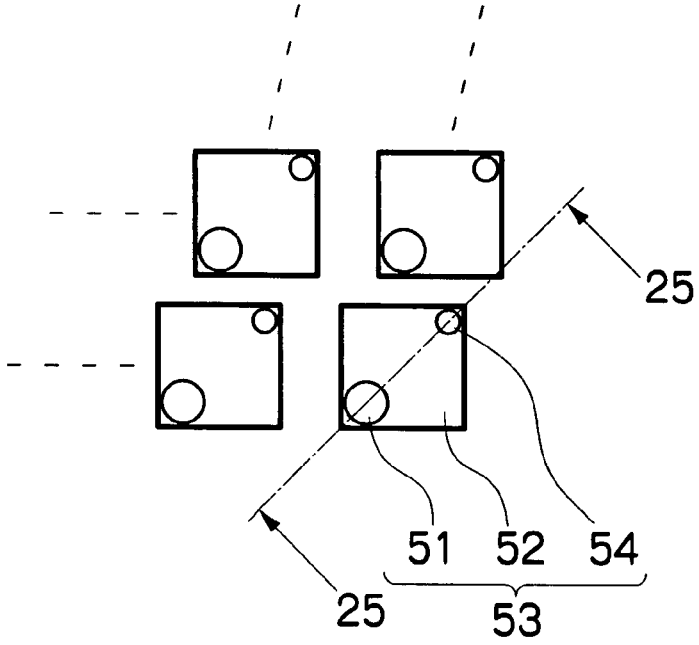
FIG. 24B is an enlarged view of a portion of FIG. 24A.
Figure 24C:
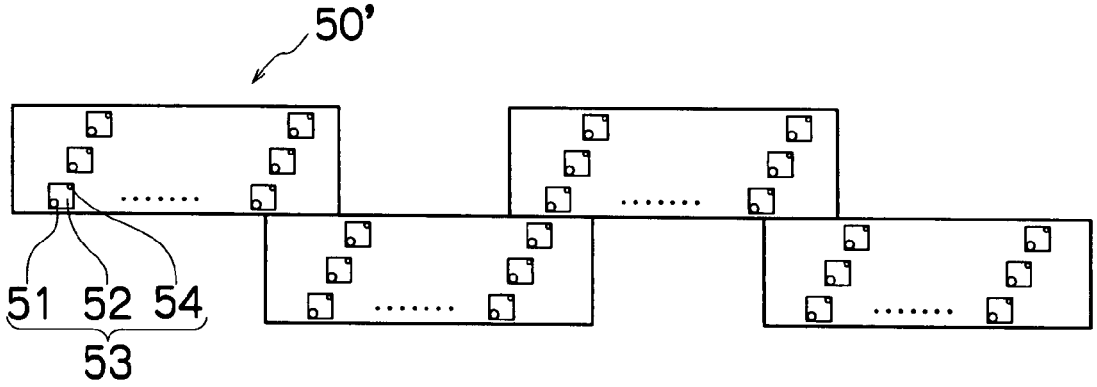
FIG. 24C is a plan view perspective diagram showing a further example of the structure of the recording head.
Figure 25:
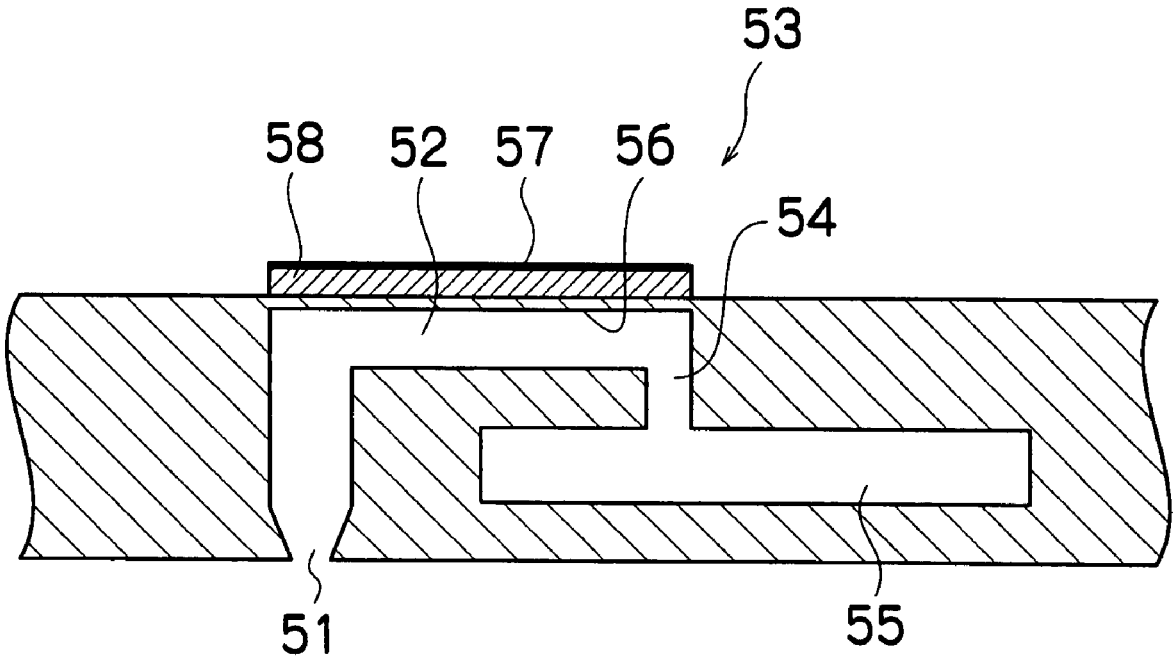
FIG. 25 is a cross-sectional diagram showing one liquid droplet ejection element (a cross-sectional diagram along line 25-25 in FIG. 24A)

FIG. 24A is a perspective plan view showing an example of the configuration of the recording head 50, FIG. 24B is an enlarged view of a portion thereof, FIG. 24C is a perspective plan view showing another example of the configuration of the head 50, and FIG. 25 is a cross-sectional view taken along the line 25-25 in FIGS. 24A and 25B, showing the inner structure of a single droplet ejection element (an ink chamber unit for one nozzle 51).

The nozzle pitch in the recording head 50 should be minimized in order to maximize the density of the dots printed on the surface of the recording paper 14. As shown in FIGS. 24A and 24B, the recording head 50 according to the present embodiment has a structure in which a plurality of ink chamber units (droplet ejection elements) 53, each comprising a nozzle 51 forming an ink ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the recording head (the direction perpendicular to the paper conveyance direction) is reduced and high nozzle density is achieved.

The mode of forming one or more nozzle rows through a length corresponding to the entire width of the recording paper 14 in a direction substantially perpendicular to the conveyance direction of the recording paper 14 is not limited to the example described above. For example, instead of the configuration in FIG. 24A, as shown in FIG. 24C, a line head having nozzle rows of a length corresponding to the entire width of the recording paper 14 can be formed by arranging and combining, in a staggered matrix, short head modules 50' having a plurality of nozzles 51 arrayed in a two-dimensional fashion.

As shown in FIGS. 24A and 24B, the planar shape of the pressure chamber 52 provided corresponding to each nozzle 51 is substantially a square shape, and an outlet port to the nozzle 51 is provided at one of the ends of the diagonal line of the planar shape, while an inlet port (supply port) 54 for supplying ink is provided at the other end thereof. The shape of the pressure chamber 52 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

As shown in FIG. 25, each pressure chamber 52 is connected to a common channel 55 through the supply port 54. The common channel 55 is connected to an ink tank (not shown), which is a base tank that supplies ink, and the ink supplied from the ink tank is delivered through the common flow channel 55 to the pressure chambers 52.

Actuators 58 each provided with an individual electrode 57 are bonded to a pressure plate (a diaphragm that also serves as a common electrode) 56 which forms the surface of one portion (in FIG. 25, the ceiling) of the pressure chambers 52. When a drive voltage is applied to each individual electrode 57 and the common electrode, the corresponding actuator 58 deforms, thereby changing the volume of the corresponding pressure chamber 52. This causes a pressure change which results in ink being ejected from the nozzle 51. For the actuators 58, it is possible to adopt a piezoelectric element using a piezoelectric body, such as lead zirconate titanate, barium titanate, or the like. When the displacement of each actuator 58 returns to its original position after ejecting ink, the corresponding pressure chamber 55 is replenished with new ink from the common flow channel 54, via the supply port 52.

Figure 26:
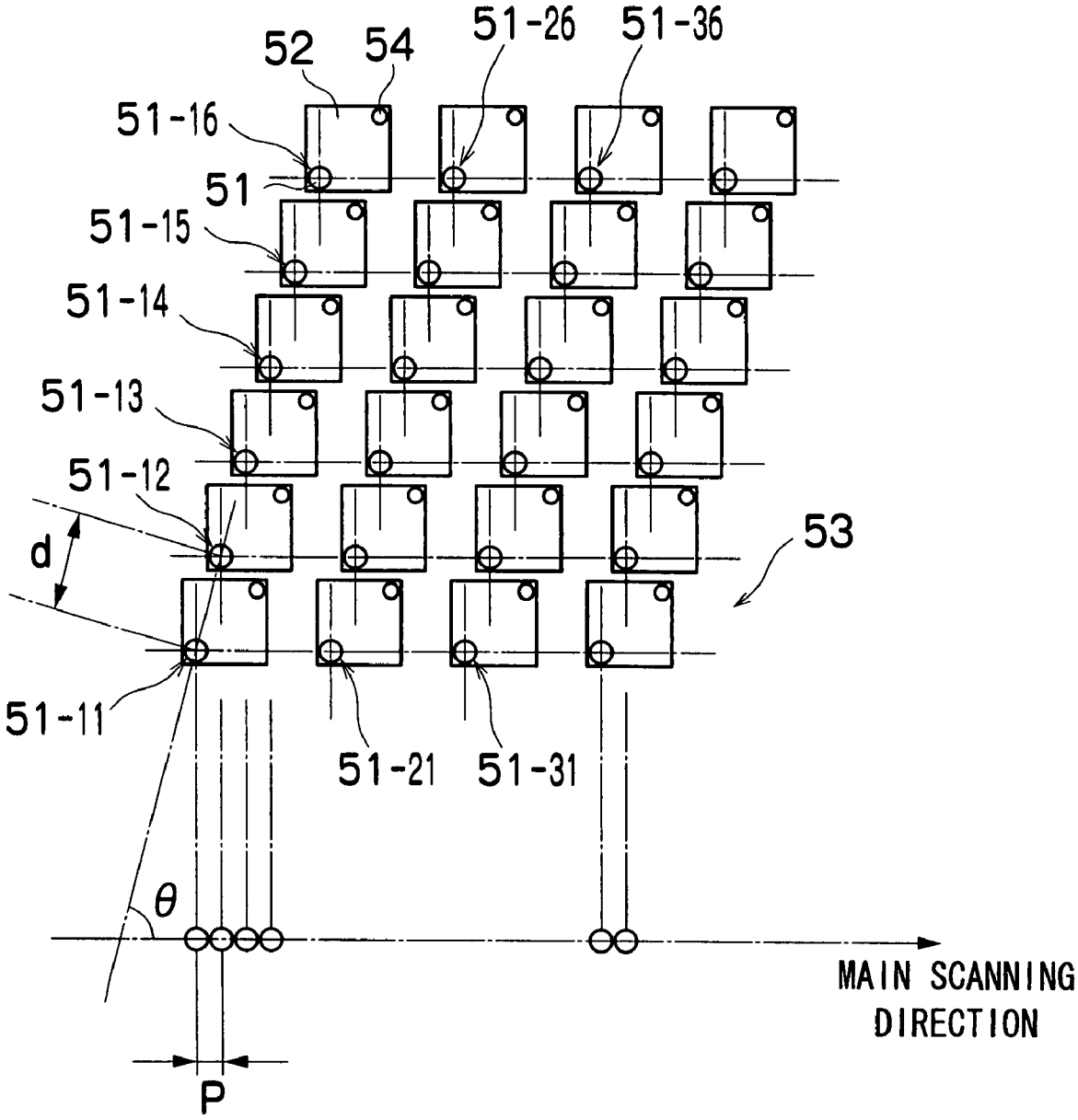
FIG. 26 is an enlarged view showing a nozzle arrangement in the recording head illustrated in FIG. 24A.

As shown in FIG. 26, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) driving all the nozzles simultaneously; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 26 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording paper 14 by sequentially driving the nozzles 51-11, 51-12, . . . , 51-16 in accordance with the conveyance velocity of the recording paper 14.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by the main scanning as described above is called the "main scanning direction", and the direction in which the sub-scanning is performed, is called the "sub-scanning direction". In other words, in the present embodiment, the conveyance direction of the recording paper 14 is called the sub-scanning direction and the direction perpendicular to same is called the main scanning direction.

In implementing the present invention, the arrangement of the nozzles is not limited to that of the example illustrated. Moreover, a method is employed in the present embodiment where ink droplets are ejected by means of the deformation of the actuators 58, which are typically piezoelectric elements however, in implementing the present invention, the method used for discharging ink is not limited in particular, and instead of the piezo-jet method, it is also possible to apply various types of methods, such as a thermal jet method where the ink is heated and bubbles are caused to form therein by means of a heat generating body such as a heater, ink droplets being ejected by means of the pressure applied by these bubbles.

Description of Control System

FIG. 27 shows a block diagram showing the system composition of the inkjet recording apparatus 11. As shown in FIG. 27, the inkjet recording apparatus 11 comprises a communications interface 70, a system controller 72, an image memory 74, a ROM 75, a motor driver 76, a heater driver 78, a print controller 80, an image buffer memory 82, a head driver 84, a measurement unit controller 90, and the like.

The host computer 13 functions as a characteristics information acquiring device which carries out calculation processing for generating data relating to depositing position error, liquid droplet volume error, or the like, from the test pattern reading data read in by the scanner 12 (the image reading device). Furthermore, it also functions as an image output device which sends image data to the communications interface 70.

The communications interface 70 is an interface unit (image input unit) which receives image data sent from the host computer 13 and thus functions as image input device. A serial interface such as USB (Universal Serial Bus), IEEE 1394, Ethernet (registered trademark), wireless network, or a parallel interface such as a Centronics interface may be used as the communications interface 70. A buffer memory (not shown) may be mounted in this portion in order to increase the communication speed.

The image data sent from the host computer 13 is received by the inkjet recording apparatus 11 through the communications interface 70, and is temporarily stored in the image memory 74. The image memory 74 is a storage device for storing images inputted through the communications interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 11 in accordance with prescribed programs, as well as a calculation device for performing various calculations. More specifically, the system controller 72 controls the various sections, such as the communications interface 70, image memory 74, motor driver 76, heater driver 78, and the like, as well as controlling communications with the host computer 13 and writing and reading to and from the image memory 74 and ROM 75. The system controller 72 also generates control signals for controlling the motor 88 and heater 89 of the conveyance system. The drive voltage sweeping step and the ink ejection amount calculation step according to embodiments of the present invention are carried out by the system controller 72.

The program executed by the CPU of the system controller 72 and the various types of data which are required for control procedures (including measurement test pattern data such as depositing position error) are stored in the ROM 75. The ROM 75 may be a non-writeable storage device, or it may be a rewriteable storage device such as an EEPROM.

The image memory 74 is used as a temporary storage region for the image data, and it is also used as a program development region and a calculation work region for the CPU.

The motor driver (drive circuit) 76 drives the motor 88 of the conveyance system in accordance with commands from the system controller 72. The heater driver 78 drives the heater 89 of the post-drying unit 42 or the like in accordance with commands from the system controller 72.

The print controller 80 includes a drive waveform generation unit 80A. The drive waveform generation unit 80A is a device for generating drive signal waveforms in order to drive the actuators 58 (see FIG. 25) corresponding to the respective nozzles 51 of the recording head 50. The signals (drive waveforms) generated by the drive waveform generation unit 80A are supplied to the head driver 84. The signals output from the drive waveform generation unit 80A may be digital waveform data, or may be analog voltage signals.

The print controller 80 is provided with an image buffer memory 82, and image data, parameters, and other data are temporarily stored in the image buffer memory 82 when image data is processed in the print controller 80. FIG. 27 shows a mode in which the image buffer memory 82 is attached to the print controller 80; however, the image memory 74 may also serve as the image buffer memory 82. Also possible is a mode in which the print controller 80 and the system controller 72 are integrated to form a single processor.

To give a general description of the sequence of processing from image input to print output, image data to be printed is input from an external source via the communications interface 70, and is accumulated in the image memory 74. At this stage, multiple-value RGB image data is stored in the image memory 74, for example.

In this inkjet recording apparatus 11, an image which appears to have continuous tonal graduations to the human eye is formed by changing the droplet ejection density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 74 is sent to the print controller 80 via the system controller 72.

In other words, the print controller 80 performs processing for converting the input RGB image data into dot data for the four colors of K, C, M and Y. The dot data generated by the print controller 80 in this way is stored in the image buffer memory 82. This dot data of the respective colors is converted into CMYK droplet ejection data for ejecting ink from the nozzles of the recording head 50, thereby establishing the ink ejection data to be printed.

The head driver 84 outputs drive signals for driving the actuators 58 corresponding to the nozzles 51 of the recording head 50 in accordance with the print contents, on the basis of the ink ejection data and the drive waveform signals supplied by the print controller 80. A feedback control system for maintaining constant drive conditions in the recording heads may be included in the head driver 84.

By supplying the drive signals output by the head driver 84 to the recording head 50 in this way, ink is ejected from the corresponding nozzles 51. By controlling ink ejection from the print head 50 in synchronization with the conveyance speed of the recording paper 14, an image is formed on the recording paper 14.

As described above, the ejection volume and the ejection timing of the ink droplets from the respective nozzles are controlled via the head driver 84, on the basis of the ink ejection data and the drive signal waveform generated by implementing the required signal processing in the print controller 80. By this means, desired dot sizes and dot positions can be achieved.

The scanner 12 reads in the image printed on the recording paper 14, and this image data is sent to the host computer 13. The recording paper 14 may be fed to the scanner 12 manually by an operator, or it may be fed between the inkjet recording apparatus 11 and the scanner 12 automatically.

The measurement unit controller 90 is a driver which drives the optical sensors 23 and the temperature sensors 24 of the sensor system, in accordance with instructions from the system controller 72.

Image recording systems and image recording methods according to the present invention have been described in detail above, but the present invention is not limited to the aforementioned examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An ink ejection amount measurement method for an inkjet recording head, the ink ejection amount measurement method comprising:

an ink ejection step of ejecting ink onto a recording medium from a recording head by applying a drive voltage to the recording head, in such a manner that an ink dot image is formed on the recording medium;

an image reading step of reading the ink dot image formed on the recording medium by means of an image reading device;

a number of pixels measurement step of measuring number of pixels occupied by the ink dot image formed on the recording medium;

a correlation table preparation step of preparing a correlation table representing a correlation among a value of the drive voltage, number of pixels occupied by an ink dot image formed on the recording medium, and an ink ejection amount ejected by the recording head;

a drive voltage sweeping step of changing a value of the drive voltage applied to the recording head, from a first drive voltage measurement value which is a value of the drive voltage when the number of pixels measured in the number of pixels measurement step is a first number of pixels, to a second drive voltage measurement value which is a value of the drive voltage at a boundary where the number of pixels measured in the number of pixels measurement step changes from the first number of pixels to a second number of pixels; and an ink ejection amount calculation step of calculating the ink ejection amount when a drive voltage having the first drive voltage measurement value is applied to the recording head, according to the correlation table, using the first drive voltage measurement value and the second drive voltage measurement value.

2. The ink ejection amount measurement method as defined in claim 1, further comprising a recording medium type determination step of determining a type of the recording medium, wherein, in the correlation table preparation step, the correlation table is prepared in accordance with the type of the recording medium determined in the recording medium type determination step.

3. The ink ejection amount measurement method as defined in claim 1, further comprising a recording head temperature determination step of determining temperature of the recording head, wherein, in the correlation table preparation step, the correlation table is prepared in accordance with the temperature of the recording head determined in the recording head temperature determination step.

4. An ink ejection amount measurement system comprising:

a recording head which ejects ink onto a recording medium by applying a drive voltage to the recording head, in such a manner that an ink dot image is formed on the recording medium;

an image reading device which reads the ink dot image formed on the recording medium;

a number of pixels measurement device which measures number of pixels occupied by the ink dot image formed on the recording medium;

a correlation table storage device which stores a correlation table representing a correlation among a value of the drive voltage, number of pixels occupied by an ink dot image formed on the recording medium, and an ink ejection amount ejected by the recording head;

a drive voltage sweeping device which changes a value of the drive voltage applied to the recording head, from a first drive voltage measurement value which is a value of the drive voltage when the number of pixels measured by the number of pixels measurement device is a first number of pixels, to a second drive voltage measurement value which is a value of the drive voltage at a boundary where the number of pixels measured by the number of pixels measurement device changes from the first number of pixels to a second number of pixels; and an ink ejection amount calculation device which calculates the ink ejection amount when a drive voltage having the first drive voltage measurement value is applied to the recording head, according to the correlation table, using the first drive voltage measurement value and the second drive voltage measurement value.

5. The ink ejection amount measurement system as defined in claim 4, further comprising a recording medium type determination device which determines a type of the recording medium, wherein the correlation table storage device stores the correlation table in accordance with the type of the recording medium determined by the recording medium type determination device.

6. The ink ejection amount measurement system as defined in claim 4, further comprising a recording head temperature determination device which determines temperature of the recording head, wherein the correlation table storage device stores the correlation table in accordance with the temperature of the recording head determined by the recording head temperature determination device.

* * * * *